US006265983B1

(12) United States Patent
Baillargeon

(10) Patent No.: US 6,265,983 B1
(45) Date of Patent: Jul. 24, 2001

(54) FALL PROTECTION SYSTEM AND METHOD

(76) Inventor: Paul D. Baillargeon, 103 Horse Corner Rd., Chichester, NH (US) 03234

( * ) Notice: Subject to any disclaimer, the term of this patent is extended or adjusted under 35 U.S.C. 154(b) by 0 days.

(21) Appl. No.: 09/408,798

(22) Filed: Sep. 30, 1999

Related U.S. Application Data

(60) Provisional application No. 60/102,583, filed on Sep. 30, 1998.

(51) Int. Cl.[7] ..... G08B 21/00

(52) U.S. Cl. ..... 340/687; 340/673; 340/679; 340/685

(58) Field of Search ..... 340/687, 679, 340/673, 685, 680, 457.1; 182/3, 46; 187/222, 231, 240, 244

(56) References Cited

U.S. PATENT DOCUMENTS

| | | | | |
|---|---|---|---|---|
| 3,777,180 | * | 12/1973 | Carlson | 340/52 E |
| 3,987,864 | * | 10/1976 | Lijima et al. | 180/82 C |
| 4,044,856 | * | 8/1977 | Stevenson | 182/2 |
| 4,116,304 | * | 9/1978 | Durnell | 182/2 |
| 4,243,118 | * | 1/1981 | Landry | 182/3 |
| 5,067,585 | * | 11/1991 | Bell | 182/7 |
| 5,883,441 | * | 3/1999 | Shoemaker | 340/667 |
| 6,140,930 | * | 10/2000 | Shaw | 340/685 |

OTHER PUBLICATIONS

Patlite Corporation, PATLITE Signaling and Warning Devices, Torrance, CA, Feb., 1999.

Schmersal Safety Interlock Switches, Man–Machine Safeguarding Requirements & Techniques, Hawthorne, NY, ©1998.

Schmersal Safety Interlock Switches, Machine Guarding Safety Products Catalog & Handbook, Hawthorne, NY, ©1998.

The Patent Engineer, Exhibits 30–38, Jan. 10, 1999—Mar. 26, 1999,, Concord, NH.

Schmersal Safety Interlock Switches, Man–Machine Safeguarding Requirements & Techniques,,, Hawthorne, NY.

Schmersal Safety Interlock Switches, Machine Guarding Safety Products Calalog & Handbook,,,Hawthorne, NY.

PATLITE Corporation, PATLITE Signaling and Warning Devices,,,Torrance, CA.

PATLITE (U.S.A.) Corporation, Catalog of Signal and Cube Towers and Rotating Warning Lights.

* cited by examiner

*Primary Examiner*—Jeffery Hofsass
*Assistant Examiner*—Hung Nguyen
(74) *Attorney, Agent, or Firm*—Bourque & Associates P.A.

(57) ABSTRACT

Disclosed is a machinery operator protection system and method, which inhibits the use of machinery unless the operator of the machinery is properly secured with a lanyard and/or body harness to the machinery. The disclosed system includes a lanyard connection detector for detecting proper attachment of at least one lanyard to a machinery operator and a lanyard interlock control for controlling a switch to selectively enable activation of the machinery when the lanyard connection detector indicates that the operator is properly attached to the machinery with the lanyard. The disclosed method includes the steps of: detecting when at least one safety lanyard is properly attached to a between a machinery operator and a piece of machinery; and inhibiting operation of the machinery unless proper operator safety lanyard attachment is detected. Optionally, the method may also include providing an audible or visual warning alarm to advise the machinery operator if he or she attempts to use the machinery without proper safety lanyard attachment.

9 Claims, 22 Drawing Sheets

1609
1612
1624
1613
1623
1611
1614
1610

1602

1605
1607
1608
1606
1604
1603
1601

1620
1616
1619
1622
1621
1618
1617
1615

FALL PROTECTION SYSTEM AND METHOD

RELATED APPLICATIONS

This application is related to and claims the benefit of Provisional U.S. patent application Ser. No. 60/102,583 entitled FALL PROTECTION SYSTEM AND METHOD, filed Sep. 30, 1998 and incorporated herein by reference.

FIELD OF THE INVENTION

This disclosed invention relates generally to fall arresting/prevention devices that provide protection to individuals who are subject to accidental falls when performing construction or the like or when operating elevating construction machinery such as aerialift boom/baskets and the like.

BACKGROUND OF THE INVENTION

Lanyards are safety straps or the like which are connected between a fixed safety platform and a body harness which is attached to the operator to be protected from a fall. However, in some circumstances the lanyard and body harness may be integrated into a single unit, which for the purposes of this discussion will also be termed a lanyard. Additionally, the body harness may take a variety of forms, ranging from a simple safety waist-style belt to a full body harness.

While there are a variety of lanyard styles, the most common variety consists of a flexible nylon strap which has two locking snap hooks, one attached at each end of the lanyard, although other configurations are possible.

One significant safety issue presented when lanyards are used in conjunction with elevating construction machinery such as aerialift booms and the like is the issue of operator compliance. In most circumstances where a construction worker is positioned on a roof or other high structure, it is relatively easy for the worker to realize the immediate need to secure himself to the structure via the use of a lanyard or similar restraining device. The exposed nature of the work environment and the inherent height of the work environment tend to provide a positive reinforcement of the need to take this safety step.

However, this type of positive reinforcement is absent in many circumstances where the worker is the operator of an aerialift boom or the like, in which a piece of construction equipment actually transports the worker to an elevated height. In this situation, the aerialift boom operator may be in an aerialift boom basket or the like, and be unaware of the potential for a serious injury from a fall while the aerialift boom is rising or positioned at an elevated height. Furthermore, many aerialift boom baskets are equipped with latching doors which provide ingress and egress from the boom basket. In these situations the operator may be unaware that should the boom door latch fail, a potential for serious injury may exist should a fall occur. In these situations, it is quite common for an aerialift boom operator to forget to secure himself/herself to the aerialift boom/basket via the use of a lanyard and body harness.

This situation is exacerbated by the fact that many operators of aerialift booms and the like make many trips up and down in the aerialift boom basket while servicing telephone poles, cable TV hardware, and the like. These scenarios are fraught with situations in which the operator may leave the aerialift boom basket, retrieve tools or the like, return to the aerialift basket, and forget to attach the safety lanyard to his/her body harness before activating the aerialift boom movement controls. It is unfortunate and very sad that there have been many situations in which this scenario has occurred, with the operator subsequently falling from the aerialift boom basket. These accidental falls tend to be quite severe, resulting in broken bones, head and back injuries, as well as documented cases of permanent paralysis.

As a result, the U.S. Occupational Safety and Health Administration (OSHA) has promulgated rules mandating fall protection standards in the workplace. These standards generally mandate that no worker be allowed to fall more than six feet and that no worker be allowed to free fall unrestrained more than two feet in a safety belt and four feet in a full body harness. While these standards generally require the use of fall protection systems and methods in conjunction with the use and operation of aerialift booms and the like, they do not dictate any positive system of enforcement regarding the use of these fall protection systems.

The alternative to the use of positive enforcement has been the use of human safety monitoring personnel (safety monitors) whose job it is to inspect the workplace and inform workers of potential fall hazards. This approach is obviously only effective in situations where the worker is operating in a group context and would be ineffective for a lone cable TV repairman, for example. The use of written fall protection plans and fall protection training are similarly ineffective in this context. Within the context of aerialift boom/baskets and the like (where the potential for serious injury resulting from an accidental fall is the greatest), the policies and procedures of OSHA seem to have the least potential for affecting an acceptable solution to this serious safety problem.

Thus, the existing methodologies do not address the human factor involved in the operation of elevating machinery which can pose potentially deadly fall hazards to their operators. In fact, government regulations and safety training are insufficient to ensure that safety devices are properly used or in fact used at all. Unfortunately, with the rapid expansion of the construction, telecommunications, and cable TV industries, the use of aerialift boom/basket devices has skyrocketed, resulting in a marked increase in accidental falls and subsequent severe injuries to workers in these fields. It is obvious from the record that fall protection training as well as policies and procedures for fall protection are inadequate to solve this problem alone.

While the use of lanyards and other fall prevention devices is widespread within the construction industry, there appears to be no art relevant to systems and methods that permit the use of these devices to be mandated or monitored to ensure their proper use. As a result, accidental falls continue to injure and disable thousands of workers per year.

Accordingly, what is needed is a system and method of preventing the use of aerialift boom/basket devices and the like unless the operator of such a device is properly secured to the aerialift boom/basket with a body harness and attached lanyard. Such a system should also minimize the operational impact on the use of existing lanyard devices by not requiring the operator/worker to perform extra safety related functions to affect mandatory use of the lanyard.

SUMMARY OF THE INVENTION

According to the teachings of the present invention, a machinery operator protection system and method, which inhibits the use of machinery unless the operator of the machinery is properly secured with a lanyard and/or body harness to the machinery, is provided.

The disclosed system generally includes a lanyard connection detector for detecting proper attachment of at least one lanyard to the operator and a lanyard interlock control for controlling a switch to selectively enable activation of the machinery when the lanyard connection detector indicates that the lanyard is properly attached intermediate said operator and said machinery.

The method includes the steps of: detecting when the safety lanyard is properly attached to said machinery operator; and inhibiting operation of the machinery unless proper operator safety lanyard attachment is detected. Optionally, the method also includes providing an audible or visual warning alarm to advise the machinery operator if he or she attempts to use the machinery without proper safety lanyard attachment.

DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENT

The following detailed description will describe the present invention in relation to elevating machinery in terms of the common context of aerialift boom/basket devices. However, the present invention should not be constrained or limited to this particular application as the teachings are equally applicable to any type of machinery or device where it is important to ensure that the operator of such is positively connected to such device. In addition, the disclosed invention can be integrated with other aerialift warning systems, such as the system disclosed in commonly-owned, co-pending U.S. patent application Ser. No. 09/347,471, entitled Aerial Lift Warning System and Method, which is incorporated herein by reference.

Figure 1:
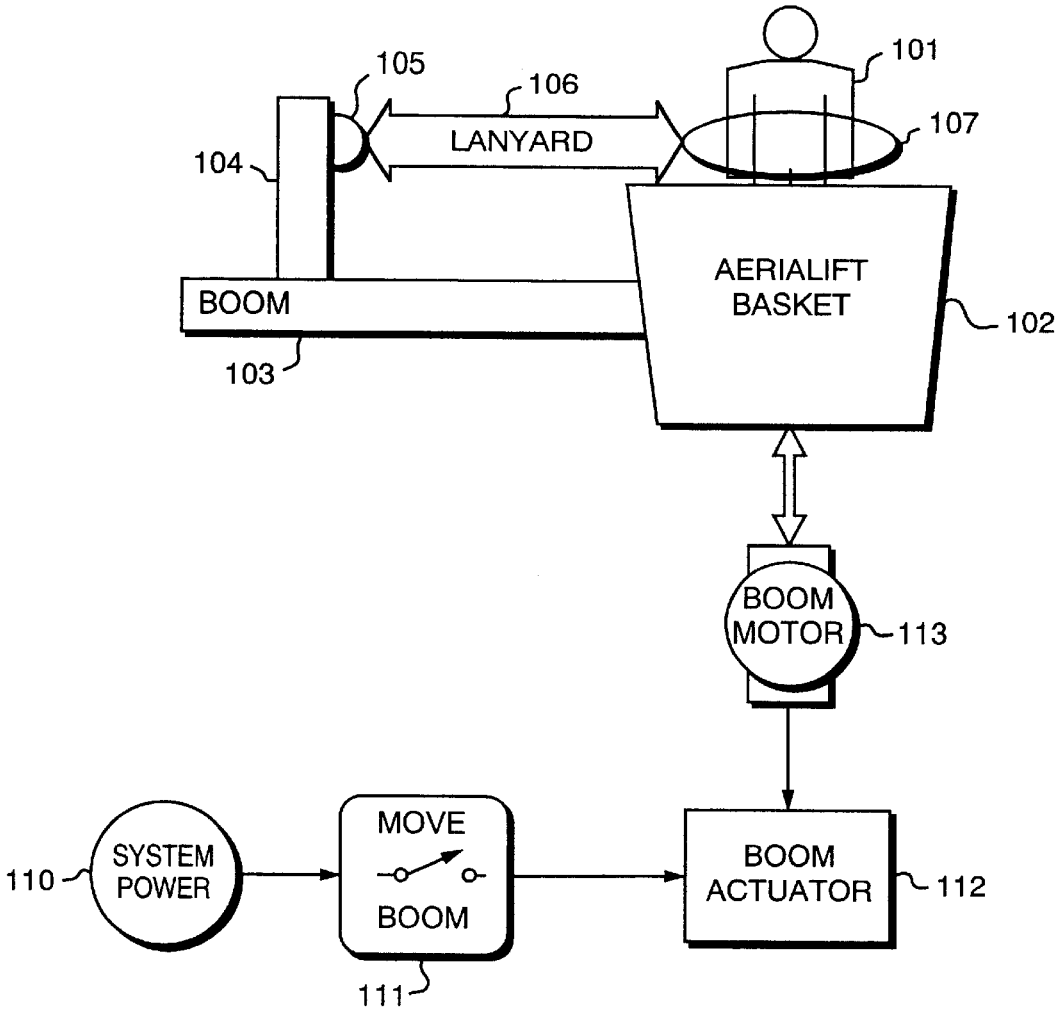
FIG. 1 (PRIOR ART)
FIG. 1 illustrates a schematic of a prior art aerialift boom/basket fall protection system utilizing a lanyard and body harness.

Turning now to the Figures and, in particular, FIG. 1, in a conventional fall protection system (100) targeted towards an aerialift boom/basket, the operator (101) is in an aerialift basket (102) supported by an aerialift boom (103). As a part of either the aerialift basket (102), aerialift boom (103), or an extension thereof (104), a lanyard (106) is connected between a body harness (107) and some securing point on the aerialift (105). Within this conventional system context, system power (110) is switched through one or more boom movement controls (111) to trigger a boom actuator (112) which energizes a boom motor (113) that moves the aerialift boom/basket (103, 102).

Figure 2:
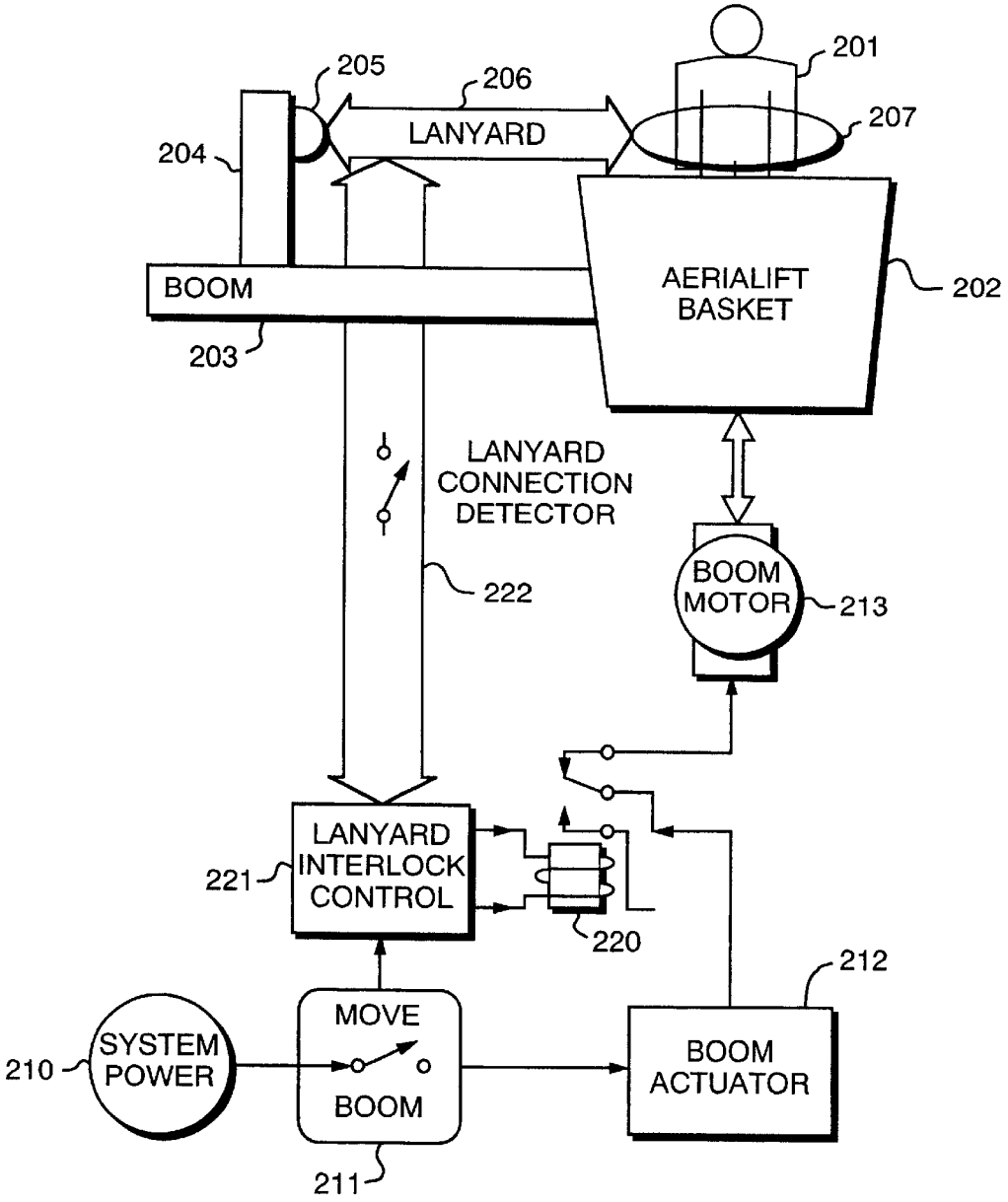
FIG. 2 illustrates a schematic of one embodiment of the present invention in which a lanyard safety interlock prevents aerialift boom movement unless the operator is properly secured via a safety lanyard.

The present invention augments this conventional prior art system as illustrated in FIG. 2. Here, the boom actuator (212) to boom motor (213) control path is broken by a controllable switch (220) which is symbolically illustrated as a relay but may be any device capable of switching electrical current. The switch (220) is controlled by a lanyard interlock control (221) which prevents the boom actuator (212) from activating the boom motor (213) unless the lanyard connection detector (222) indicates that the lanyard (206) is properly attached between the operator body harness (207) and some securing point (205) on the aerialift boom/basket (202, 203, 204).

It should be noted that the system illustrated in FIG. 2 implies a normally energized boom actuator (212) to boom motor (213) path. The present invention is not limited to this context and can be easily modified such that the lanyard safety interlock control (221) does not energize the switch (220) unless a positive indication of the lanyard connection detector (222) is indicated. This alternative configuration prevents boom motor (213) and subsequent aerialift basket (202) movement in the event of a system failure within the lanyard interlock control (221).

The lanyard interlock control (221) design is in part determined by the method by which the lanyard connection detector (222) is implemented. The remainder of the detailed description will concern alternative embodiments of the lanyard connection detector 222 and methods of detecting whether an operator (201) has properly attached the lanyard (206) from the body harness (207) to the aerialift boom/basket structure (205, 204, 203, 202).

Figure 3:
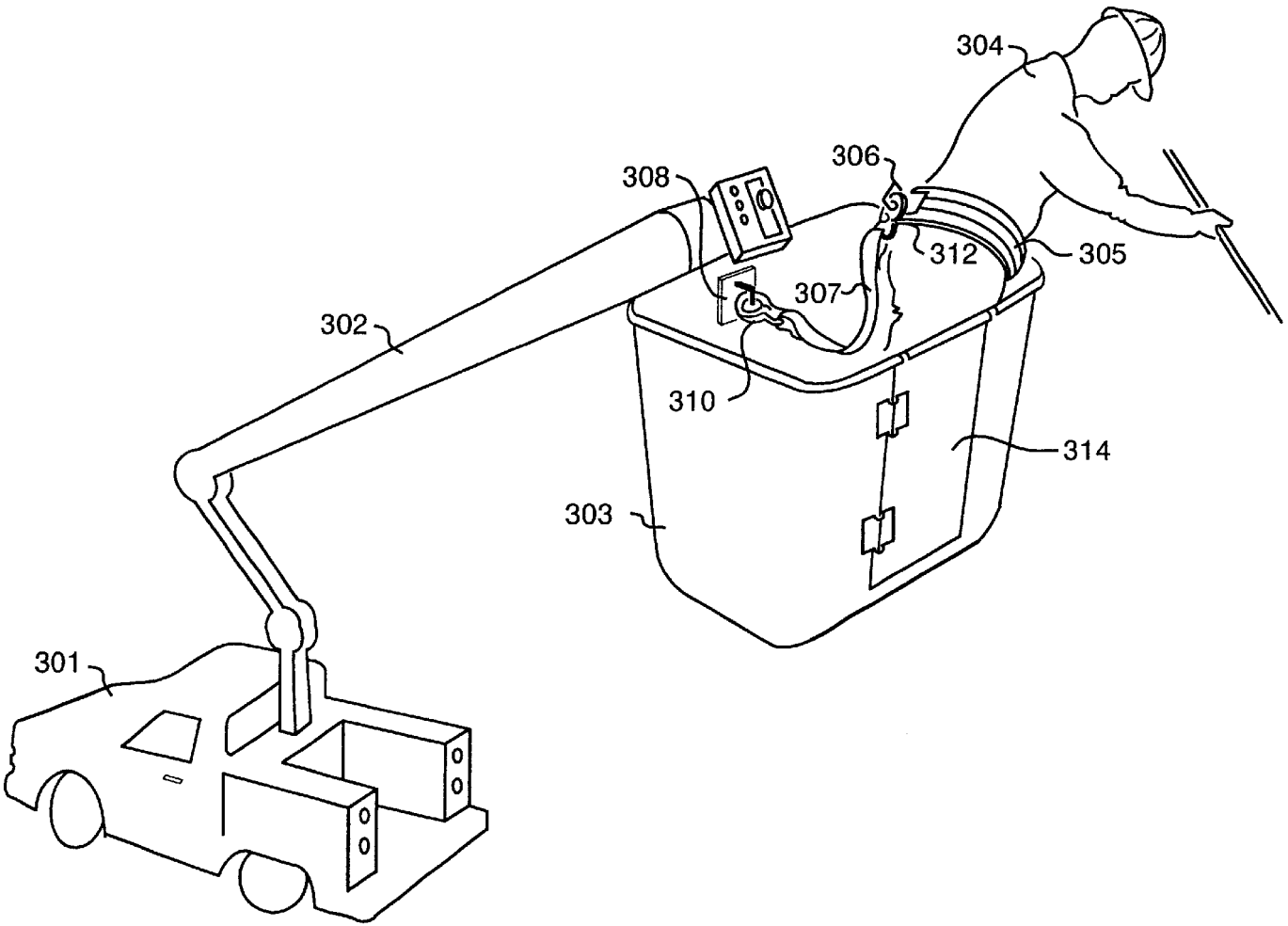
FIG. 3 (PRIOR ART)
FIG. 3 illustrates a conventional aerialift boom/basket applications and the connection of the elevated machine operator to the aerialift boom/basket.

The following exemplary embodiments will present an application context of providing fall protection in an aerialift boom system as illustrated in FIG. 3. A conventional aerialift boom application has a truck (301) or other support on which an aerialift boom (302) supports an aerialift basket (303) in which an operator (304) works. This aerialift operator (304) is typically restrained to the aerialift basket (303) via a body harness (305) equipped with a harness D-ring (306) which connects a safety lanyard (307) having fasteners, such as snap hooks (310, 312), which connect the harness D-ring (306) to an attachment point, such as support D-ring (308). In addition to the threat of falling over the top edge of the aerialift basket (303), there exists a fall hazard presented by door (310) of the aerialift basket.

Within the context of the exemplary embodiments the support D-ring (308) has been stylized to be located on the aerialift basket (303), however in many preferred embodiments support D-ring(s) (308) may be attached directly or indirectly to the aerialift boom (302) via a mounting bracket or similar structure.

Figure 4:
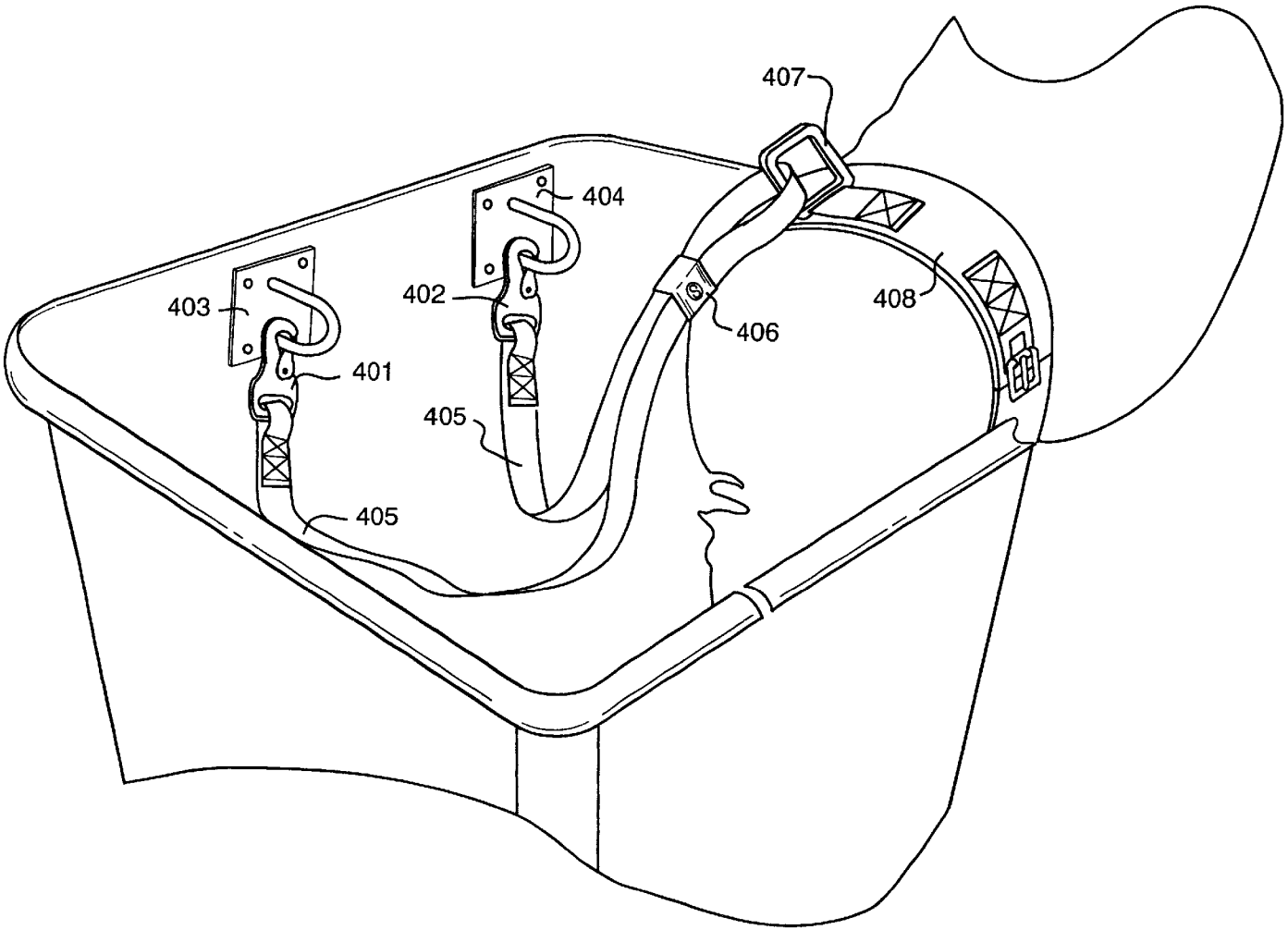
FIG. 4 illustrates one embodiment of the present invention utilizing a looped lanyard implementation.

One embodiment of the lanyard connection detector (222) (FIG. 2) is illustrated in FIG. 4. Here, the conventional one-piece lanyard (307) of FIG. 3 having two snap hooks (310, 312) connected via a nylon strap or the like is replaced with a looped lanyard, which differs from a one-piece lanyard in the following manner:

1. The lanyard (405) is increased in length to approximately double its normal length, and encircles the harness D-ring (407) which is secured to the body harness (408).
2. The lanyard loop encircling the harness D-ring is closed and secured with a fastening means (406) to ensure that the effective length of the safety lanyard is approximately half of its full length, or the proper length (as required by OSHA).
3. First and second securing attachment points, such as D-rings and their associated mounting plates (403, 404), are used on the aerialift boom/basket rather than a single securing D-ring.
4. The securing D-rings and mounting plates (403, 404) attached to the aerialift boom/basket are electrically separated to provide a means of completing an electrical circuit when the fasteners, such as snap rings (401, 402), of the lanyard are connected at each of the securing D-rings.
5. The lanyard strap (405) is treated with a conductive agent, such as zinc oxide or the like or is impregnated with conductive strands to permit the conductivity of the lanyard to rise to a level which may permit its overall resistivity to be measured.
6. A conductivity sensor is incorporated between each of the securing D-rings to permit detection of the presence of the semi-conductive lanyard intermediate each of the securing D-rings.

The key to this embodiment example is the transformation of the safety lanyard from essentially an 'insulator' to a 'conductor'. However, within the context of this embodiment the term 'conductor' must be given broad scope. For instance, it may be possible to treat the lanyard with a conductive solution and impregnate the nylon weave with zinc oxide or some other material which would provide for a nominal conductance in the range of hundreds of millions or even billions of ohms and still be able to detect this resistance between the securing D-rings on the aerialift boom/basket. In this application and throughout this document, the use of zinc oxide should be equated with any conventional method of providing marginal conductivity. Many of these techniques are well known in the art of preventing electrostatic discharge (ESD) in the electronics industry, and range from conductive clothing materials to conductivity agents which are used to dope clothing and work materials to increase their conductivity above the level of a conventional insulator.

Additionally, while the system illustrated may operate best in terms of a DC resistance measurement, it may also be possible to determine the proper connection of the safety lanyard clips by use of an AC capacitance measurement. This approach may be of use in instances where it is desirable to maintain a high degree of DC isolation between the body harness and the aerialift support D-rings, as may be the case in some power line maintenance machinery. The technique of converting the safety lanyard strap from a conductive to a reactive sensor will be discussed more fully below.

Figure 5A:
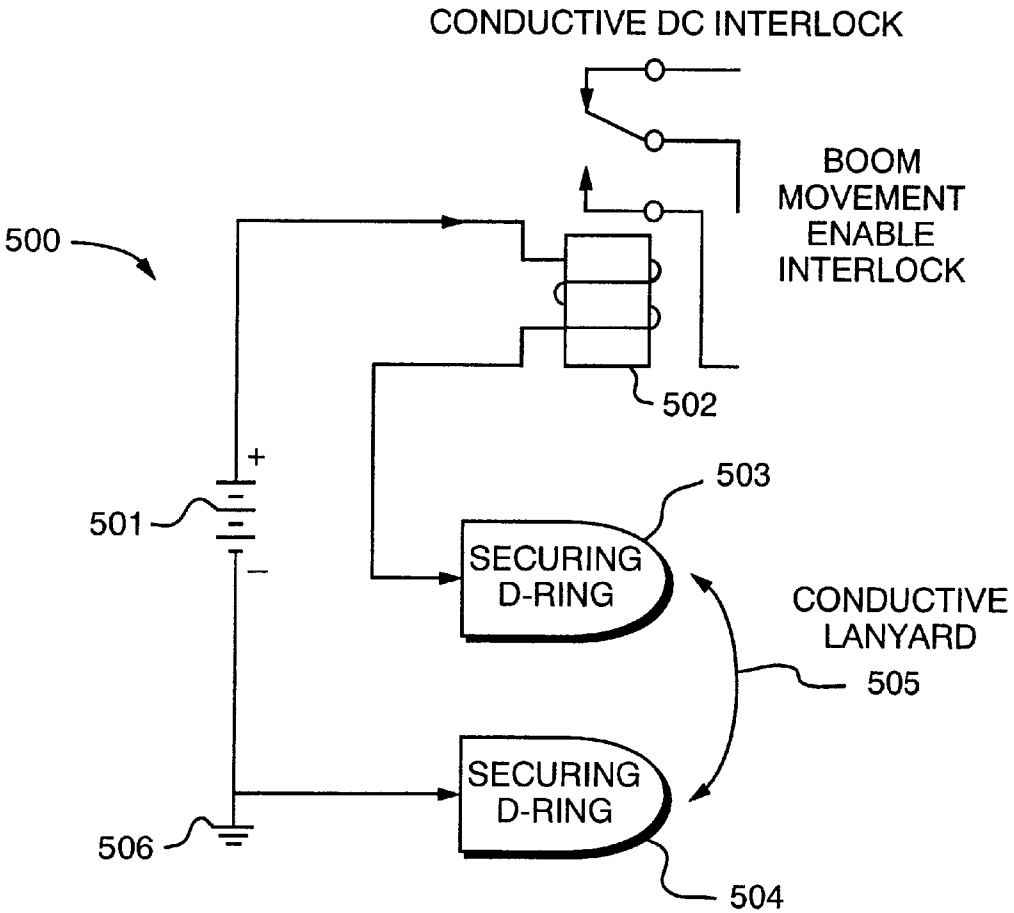
FIGS. 5A and 5B illustrate a schematic of an exemplary embodiment of the present invention in which the securing D-rings may be electrically isolated from the ground and circuitry of the aerialift boom, thus increasing the overall operational safety of the lanyard interlock system.
Figure 5B:
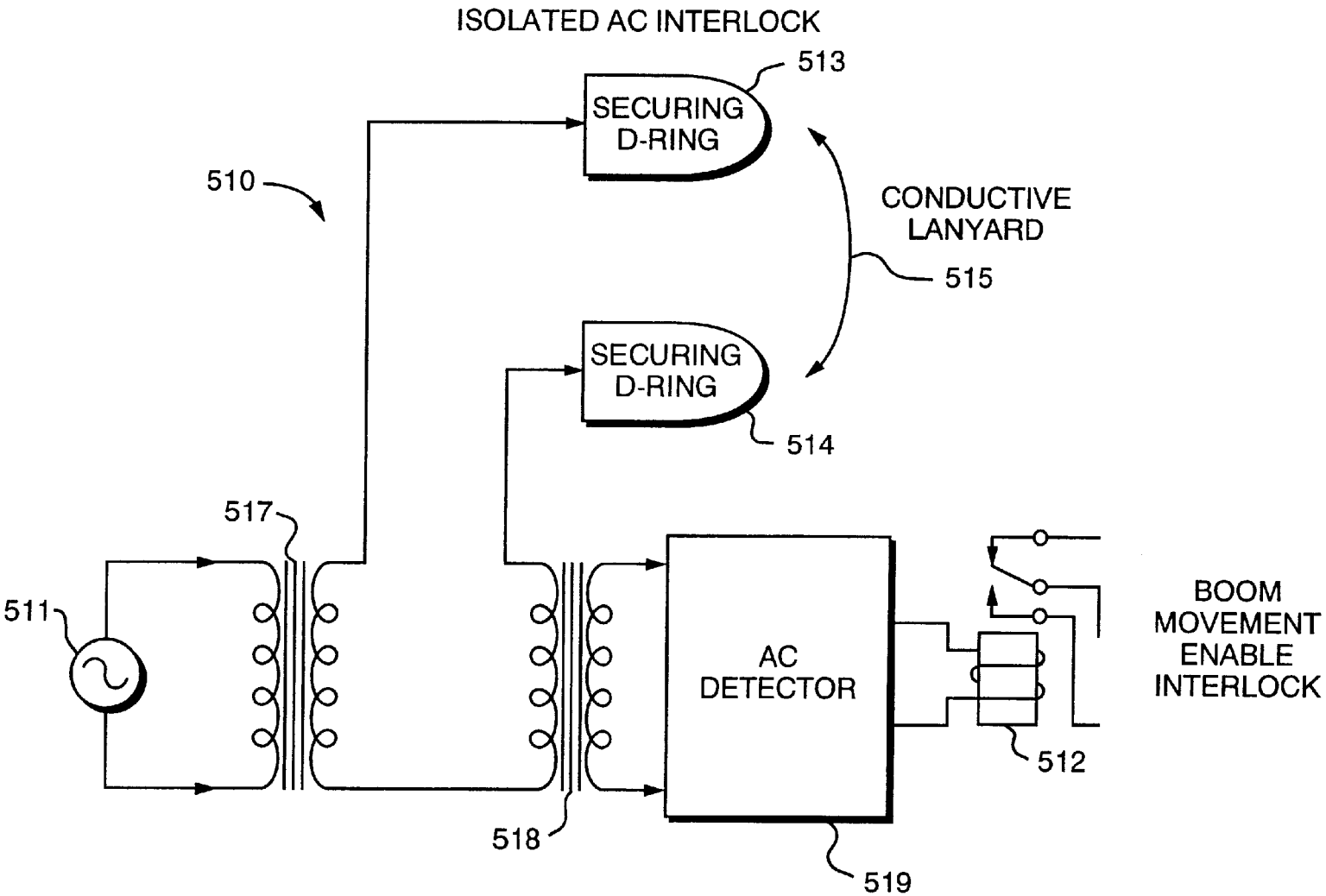

It should be noted that in many circumstances the concern over a direct conductive path between the securing D-rings and the electrical ground of the aerialift boom/basket may be addressed by configurations similar to that illustrated in FIGS. 5A and 5B. Here, the conductive DC interlock is illustrated by the schematic (500) generally, wherein a battery (501) or other power source is used to supply current through the securing D-rings (503, 504) and the conductive lanyard to supply operating current to the boom movement enable interlock (502). In this scenario, there is a DC path between the securing D-rings (503, 504) and the system ground (506) which can present a safety threat in some operating environments.

In 5B, the isolated AC interlock illustrated by the schematic (510) utilizes an AC signal source (511) which is isolated by transformers (517, 518) from the securing D-rings (513, 514) and the conductive lanyard (515). Once the electrical connection between the securing D-rings (513, 514) and the conductive lanyard (515) is made, AC current will flow in the secondary of transformer (518) and be used by AC detector (519) to trigger the boom movement enable interlock (512).

The advantages of this embodiment include a relatively robust and durable lanyard which has minimal modification requirements over existing lanyard systems. The installation of the second securing D-ring is a minor extension of current lanyard securing methods.

One disadvantage of this disclosed embodiment is that it requires TWO securing operations each time the operator secures the safety lanyard to the aerialift boom/basket. While many safety administrators may view this as an advantage in that the operator is now doubly secured to the aerialift, from an operator point of view the requirement that two snap hooks be attached to the aerialift presents a significant burden in everyday use, since the securing operation in general may happen dozens of times during a given day or during a series of maintenance functions.

Yet another potential disadvantage of this approach is the issue of the potential for defeating the lanyard interlock. Using just the conductivity between the securing D-rings as the method of detecting the presence of a properly attached lanyard can be defeated by simply tying a wire between the securing D-rings. This in essence would defeat the interlock by falsely indicating to the resistance detection system previously discussed that the lanyard was properly attached when in fact it is not. This potential for safety interlock circumvention is addressed by other embodiments of the present invention which are addressed in more detail herein.

Thus, this embodiment prevents aerialift boom operation in the absence of two secured safety clips which are part of an integrated lanyard safety system.

Figure 6:
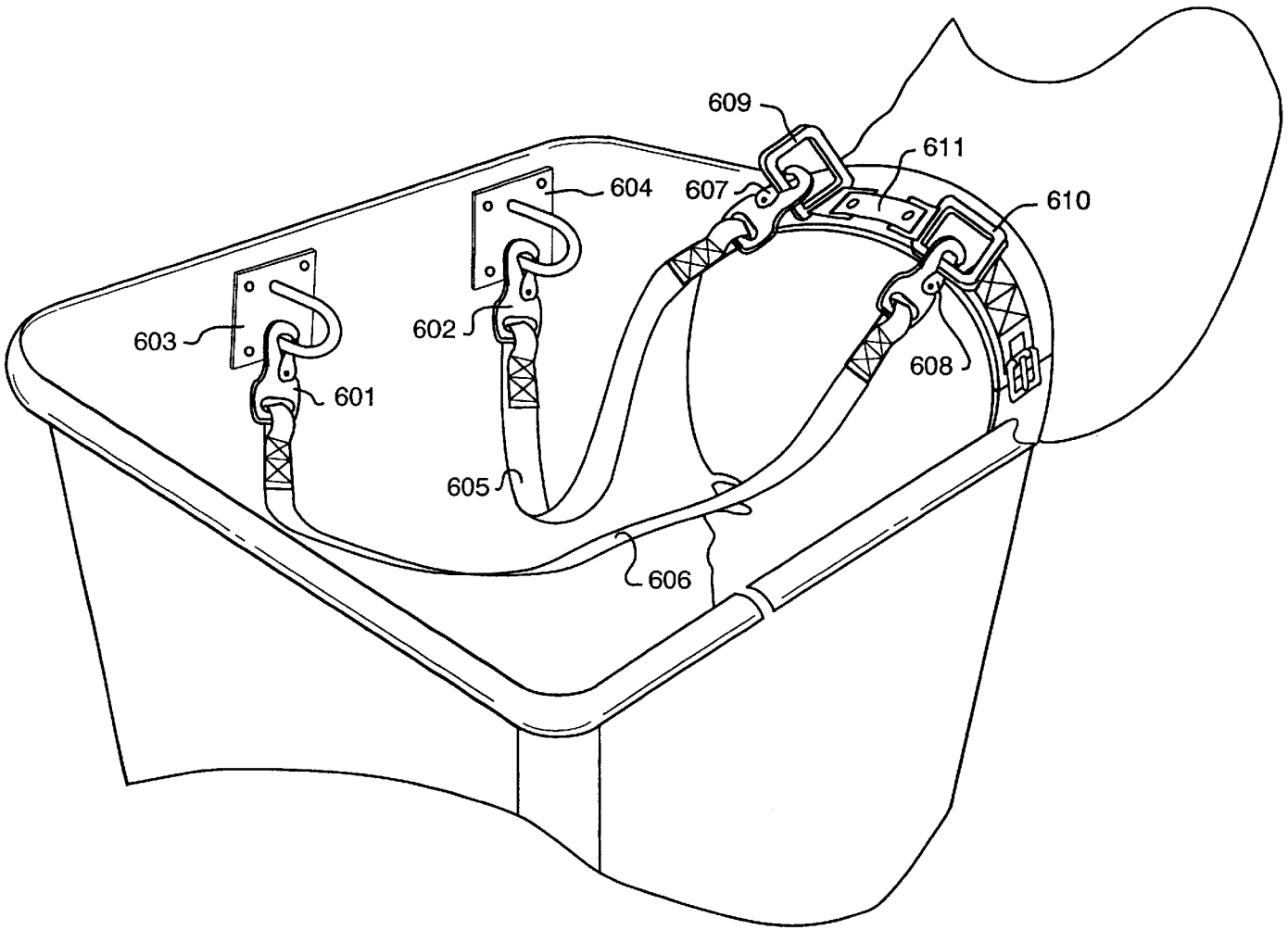
FIG. 6 illustrates another embodiment of the present invention using a dual lanyard implementation.

Another embodiment of the lanyard connection detector (222) (FIG. 2) is illustrated in FIG. 6. Here, the conventional one-piece lanyard of FIG. 3 having two snap hooks connected via a nylon strap or the like is augmented in the following manner:

1. Rather than a single lanyard as in the previous embodiment, this embodiment utilizes first and second lanyards (605, 606) to connect the harness D-rings (609, 610) to the body harness (611).
2. Two securing D-rings and their associated mounting plates (603, 604) are used on the aerialift boom/basket rather than a single securing D-ring.
3. The securing D-rings and mounting plates (603, 604) attached to the aerialift boom/basket are electrically separated to provide a means of completing an electrical circuit when the snap rings of the lanyard are connected at each of the securing D-rings.
4. The lanyard straps (605, 606) are treated with a conductive agent, such as zinc oxide or the like or is impregnated with conductive strands to permit the conductivity of the lanyard to rise to a level which may permit its overall resistivity to be measured.
5. A conductivity sensor is incorporated between each of the securing D-rings to permit detection of the presence of the semi-conductive lanyard between each of the securing D-rings.
6. At least one operator attachment point, such as harness D-rings (609, 610), are fitted on the body harness to permit attachment of the lanyards from the securing D-rings on the aerialift boom/basket via the use of snap hooks (607, 608).

The major difference between this embodiment and the embodiment of FIG. 4 is the fact that conventional, commercially available, safety lanyards may be used in this system after they are properly treated to become at a minimum marginally conductive to electric current. This results in a potential for overall reduction in tooling costs over the previous embodiment.

The D-rings on the body harness may be constructed in a wide variety of ways. In some preferred embodiments, there are more than one D-ring on the body harness, permitting separate connection of the conductive lanyards to each separate D-ring. This approach has the advantage of permitting a variation of the looped lanyard conductance methodology described previously.

Figure 7:
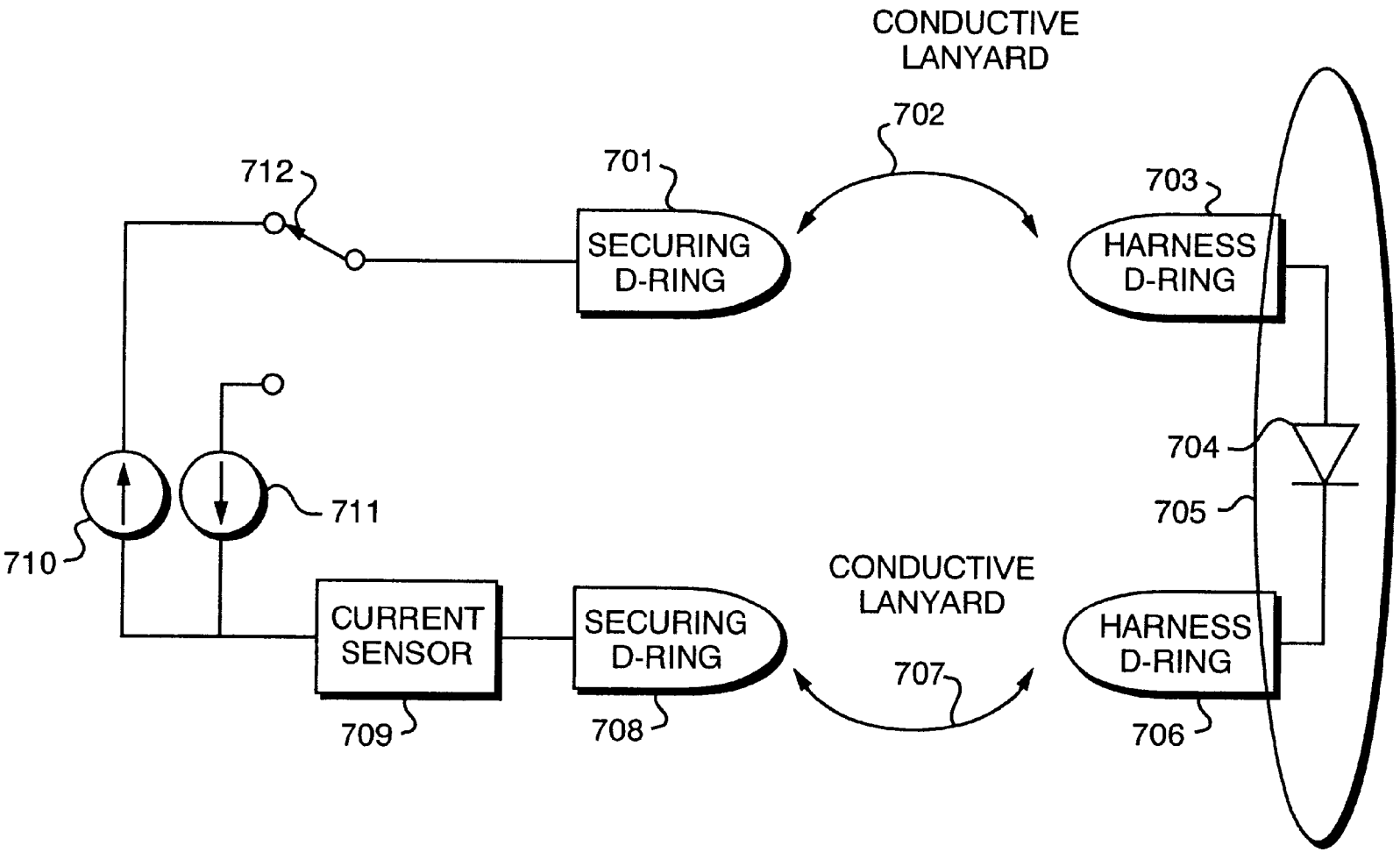
FIG. 7 illustrates a schematic of an exemplary embodiment of the present invention in which a diode or other current steering element in conjunction with bidirectional current generators is used to prevent circumvention of the lanyard safety interlock system.

In the looped lanyard methodology, the resistance between the lanyard securing D-rings is measured to determine in a DC or AC sense whether the lanyard is properly attached to the body harness. The disadvantage of this approach is that the safety interlock can be defeated if a simple electrical connection is made between the securing D-rings. To prevent this situation, if two D-rings are placed in an electrically isolated fashion on the body harness, a diode or similar 1-way conducting device can be placed between these D-rings. This simple addition as illustrated in FIG. 7 permits direct current to flow in one direction only through the safety lanyards. This condition can be detected by appropriate electronics which drive current at the securing D-rings, thus permitting the detection of a properly attached safety lanyard.

Referring to FIG. 7, this embodiment of the present invention operates by the addition of diode (704) or other device to permit current flow in only one direction in the system. Current enters the lanyard through securing D-ring (701) and is transmitted via conductive lanyard (702) to harness D-ring (703) where it is either conducted or blocked by diode (704) based on the sense of the attempted current flow. Harness D-rings (703, 706) and diode (704) are typically mounted on a single mechanical structure on body harness (705), but many other implementations using this general teaching are possible. Current flowing out of diode (704) is conducted through harness D-ring (706) through conductive lanyard (707) to securing D-ring (708). This current then flows through a current sensor and back to either one of directional current sources (710, 711).

Note that switch (712) determines which current source (710, 711) is selected for testing the presence of proper lanyard attachment. While DC current sources are illustrated here, the result could just as easily be accomplished using an AC source. In either circumstance, the current sensor (709) will detect current flow in one switch (712) position and no current flow in the other switch position. If this condition is met, the system can be assured that the operator has properly attached both safety lanyards between the securing D-rings (701, 708) and the corresponding harness D-rings (703, 706).

Most importantly, any attempt by the operator to defeat the safety interlock by placing a conductive lanyard (702, 707) across the securing D-rings (701, 708) will permit current to flow in BOTH positions of the switch (712), and thus this will be an indication that the safety lanyards are NOT properly attached. Note that the current sensor (709) can be replaced by a voltage sensor attached to securing D-rings (701, 708), which will detect the open circuit voltage of current sources (710, 711) when diode (704) is not conducting, and a conventional diode drop (typically 0.6 volts) when diode (704) is conducting. Thus, when using a voltage sensor rather than a current sensor, a differential in measured voltage must be observed when the switch (712) is in different positions for the system to properly detect that the safety lanyards are properly attached.

Yet another approach to detecting whether the lanyards are properly attached to the harness D-rings is the use of what in the electronics industry is termed a '1-wire autoidentification device' such as that made by Dallas Semiconductor Corporation of Dallas, Tex. and marketed as the 'TOUCH MEMORY' and 'iButton' product lines. These devices are essentially semiconductor memories which are accessed using two electrical connections: (1) power/data and (2) ground. These devices are available in TO-92 form factors as well as conventional lithium battery canister form factors and as such are amenable to use in this application. Since these are in fact memory devices, they may be accessed to obtain serial numbers and other information regarding which operator used which aerialift. Additionally, if desired it is possible using these devices to determine how many times the aerialift boom operator failed to attach his/her safety lanyard prior to operating the aerialift boom/basket. This feature can be useful in safety monitoring and compliance control by government agencies such as OSHA as well as providing indications to safety management as to which aerialift operators require additional safety training.

The approach given in this exemplary embodiment has the advantage of providing twice the safety support for the operator in the event of a potential fall, as two safety lanyards are always attached to the operator's body harness and the aerialift boom/basket.

Most notable in this implementation is the potential for eliminating the safety interlock circumvention mechanism present in the looped lanyard configuration. By utilization of a diode or other differential current or autoidentification semiconductor device, it is possible to eliminate the possibility that the operator has shorted the securing D-rings together in an attempt to defeat the safety system. This is a highly desirable result given that most aerialift operators are unsupervised in the field and as such there is very little positive monitoring which can be performed once the aerialift operator is on the job and using the aerialift.

However, as stated previously, the use of multiple lanyard connections creates an operational overhead that is not desirable in most aerialift applications. Nonetheless, in situations where safety is paramount, this embodiment has merit in ensuring that should one lanyard fail, that the operator would still be protected by virtue of the remaining safety lanyard. Therefore, the dual lanyard approach illustrated by this embodiment permits an increase in operator safety margin while simultaneously eliminating a potential safety threat posed by operators who attempt to circumvent the lanyard safety interlock system.

Figure 8:
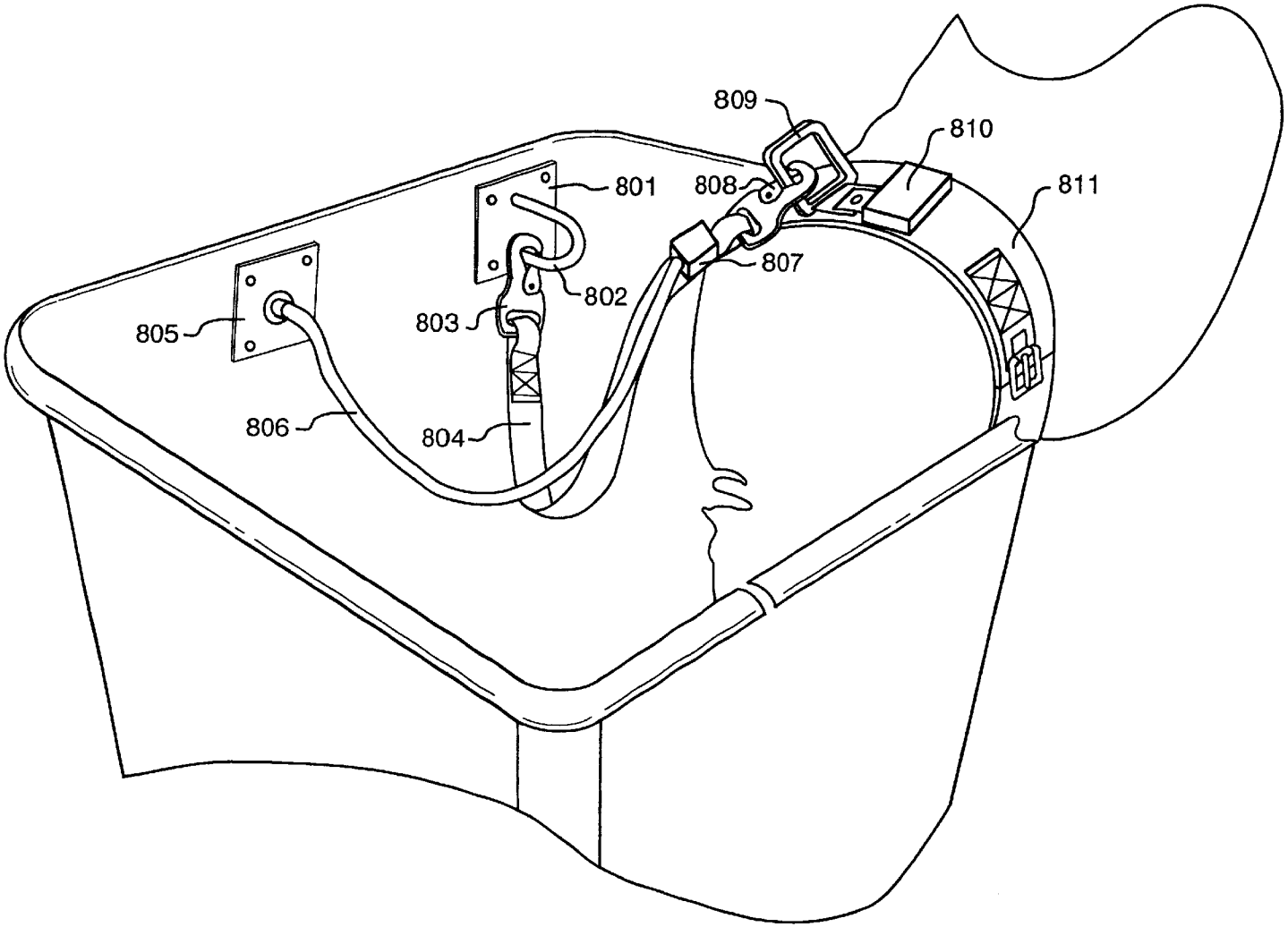
FIG. 8 illustrates yet another embodiment of the present invention using a magnetic sensor.

Another embodiment of the lanyard connection detector (222) (FIG. 2) is illustrated in FIG. 8. Here, the conventional one-piece lanyard of FIG. 3 having two snap hooks connected via a nylon strap or the like is augmented in the following manner:

1. A multi-wire cable (806) is attached to the lanyard (804) and connected (805) to the aerialift boom at the support D-ring side of the lanyard.
2. The additional cable (806) runs the length of the safety lanyard (804) and terminates at a magnetic sensor (807).
3. The snap hook (808) which connects to the harness D-ring (809) is constructed of a metal which is capable of being temporarily magnetized with a permanent magnet.
4. The harness D-ring (809) is constructed of a metal which can be temporarily magnetized via the use of a permanent magnet.
5. The harness D-ring (809) is fastened to the body harness via a metal plate which supports magnetism.
6. One or more permanent magnets (810) are attached to the metal plate, making the harness D-ring (809) permanently magnetic.

In this embodiment, the sensor, which determines whether the safety lanyard is properly attached is magnetic. When the operator attaches the snap hook (808) at the end of the safety lanyard to the harness D-ring (809), the magnetic sensor (807) at the end of the safety lanyard will detect that the lanyard snap hook (808) has experienced an increase in magnetic field. This increase in magnetic field is the result of an indirect magnetic connection between the permanent magnets (810) in the body harness which magnetize the harness D-ring (809) and subsequently the snap hook (808) at the end of the safety lanyard (804).

As one skilled in the art will be aware, there are a wide variety of devices and methods of detecting the presence of a magnetic field near the end of the safety lanyard. Two potential candidates for this application include the use of a magnetic reed relay switch as well as the use of Hall effect sensor.

Magnetic reed relay switches are widely used in the home burglar alarm industry and the like and essentially are switches which, when exposed to a magnetic field close, making an electrical switch contact. These types of switches are well known in the art and in general require a relatively large magnetic field to enable their closure. A larger magnetic field requirement requires tighter coupling between the safety lanyard snap hook and the harness D-ring, meaning more assurance of a properly connected lanyard.

Hall effect sensors, such as manufactured by Allegro MicroSystems, Inc. of Worcester, Mass. and Melexis Incorporated of Webster, Mass., come in a wide variety of configurations, most of which would be suitable for this application. The advantage in using a Hall effect sensor is in general greater sensitivity, smaller size, and more rugged construction as compared with convention magnetic reed relay switches. Additionally, for this application it is envisioned that the wide variety of linear Hall effect sensors would be particularly useful, as these devices would permit the threshold of mating contact to be adjusted as desired for optimal system safety and interlock effectiveness.

The advantages of this embodiment as compared to the looped lanyard and dual lanyard approaches is that only a single lanyard snap hook need be connected to the harness D-ring to affect proper lanyard safety and activate the lanyard safety interlock.

The disadvantages of this particular embodiment generally fall into two categories. First, the use of any electrical wiring or connector along in conjunction with the lanyard poses a reliability problem. Lanyards are in general subject to rough treatment during the course of daily use. It is possible that any wiring attached to the lanyard would break, rendering the safety interlock system inoperable. Second, the addition of magnets to the safety harness D-ring structure increases the weight of the safety harness and contributes to general operator fatigue.

Thus, the magnetic interlock embodiment of the present invention provides a significant advantage over the prior art by permitting the aerialift boom movement to be inhibited unless a single lanyard connection is found to be properly secured between the operator and the aerialift boom. While the deficiency of the system is primarily one of proper materials selection, the system shown in FIG. 8 permits this embodiment to be implemented using commercially available parts with no major modifications to existing lanyard and body harness hardware.

Figure 9:
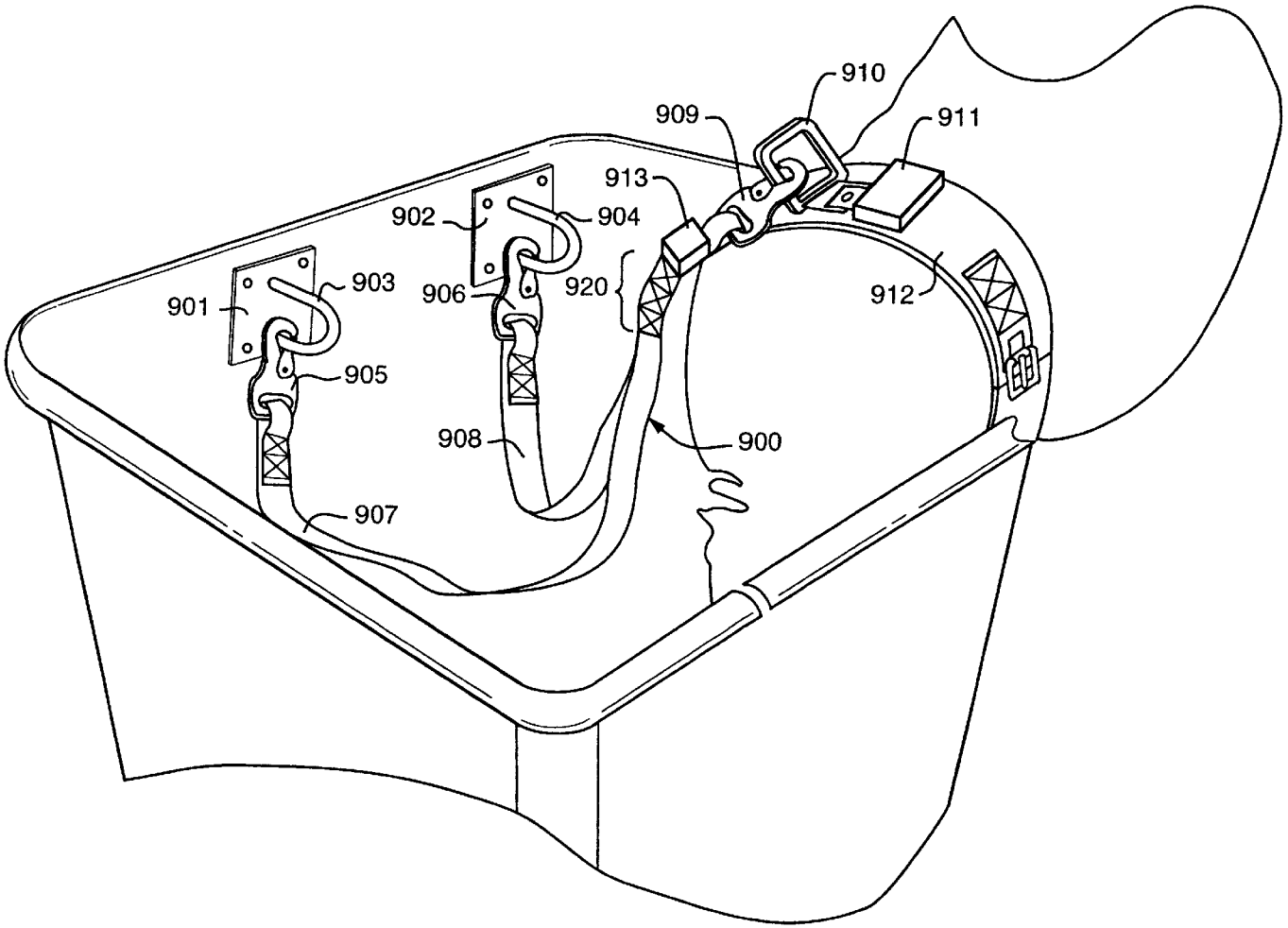
FIG. 9 illustrates an additional embodiment of the present invention using a Y-style lanyard with a magnetic sensor.

Another embodiment of the lanyard connection detector (222) (FIG. 2) is illustrated in FIG. 9. Here, the conventional one-piece lanyard of FIG. 2 having two snap hooks connected via a nylon strap or the like is augmented as illustrated in FIG. 9 in the following manner:

1. The modifications are substantially identical to the magnetic interlock exemplary embodiment discussed above, with the exception that two support D-rings (903, 904) are required on the aerialift boom.
2. The lanyard belt (907, 908) is constructed as a conductive Y-style lanyard (900), such that two snap hooks (905, 906) are connected to the aerialift boom/basket support D-rings (903, 904) and these belts are configured to support the conduction of two separate conductors to the magnetic sensor (913) described in the magnetic interlock embodiment described above.

The major distinction between this embodiment and that of the magnetic interlock embodiment described above is in a refinement of the lanyard so that it supports the conduction of two currents to the magnetic sensor instead of requiring the use of separate wires for this function. By integrating the wiring function into the lanyard, this embodiment greatly extends the lifespan of the lanyard, which is typically subjected to rough treatment and abuse in the field.

The Y-style lanyard (900) as constructed in FIG. 9 may actually comprise TWO separate lanyards (907, 908) that have been sewn together along a portion of their length (920). On the outside of each of these lanyards prior to the sewing process a conductive material such as tape, foil, or the like has been placed. Once the lanyards are sewn together the two conductors can be brought out to the magnetic sensor and used as wires to conduct information to and from the magnetic sensor.

Another approach to this problem is to have conductive material woven into each lanyard prior to its being attached to its mate via sewing. These inner conductors would be protected from the environment and can then be brought out to the support snap hooks and the magnetic sensor as desired.

One advantage to this approach is the elimination of separate wires in the magnetic interlock embodiment, which results in a much greater system reliability, since lanyards are often subject to harsh treatment.

Thus, the Y-style conductive lanyard (900) appears to solve most of the major operational problems of the magnetic interlock embodiment as well as providing a single point of aerialift boom/basket connection between the operator and the safety lanyard. This is a significant leap in protection because for the first time a system and method for integrating a lanyard interlock with a single manual hookup operation has been demonstrated. This permits current aerialift operators to function just as they do currently, with the added provision that any failure to properly attach their safety lanyard will disable movement of the aerialift boom/basket.

Figures 10A, 10B:
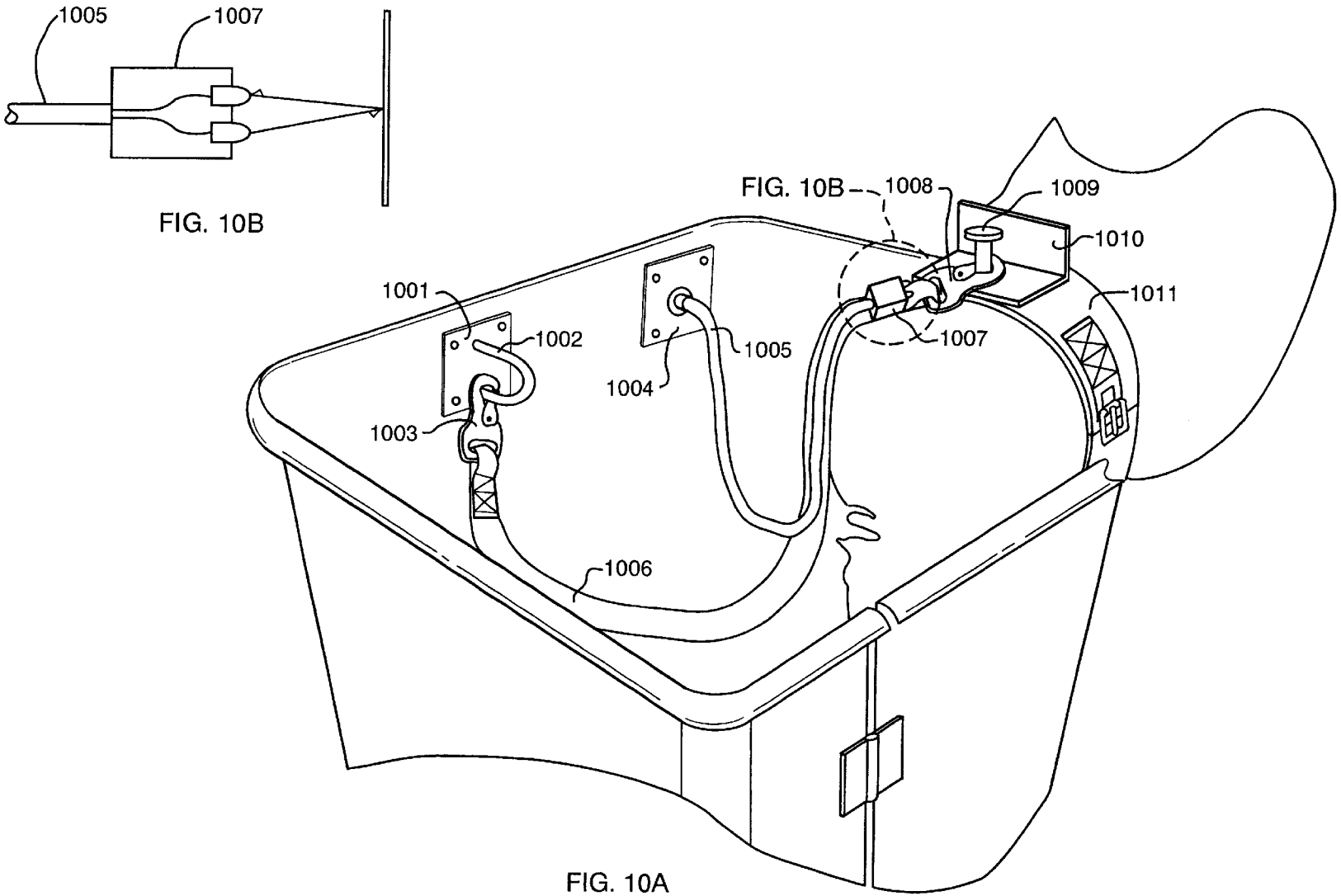
FIG. 10 illustrates another embodiment of the present invention using an optical feedback mechanism.

Another embodiment of implementing the lanyard connection detector (222) (FIG. 2) is illustrated in FIG. 10. Here, the conventional one-piece lanyard (307) of FIG. 3 having two snap hooks (310, 312) connected via a nylon strap or the like is augmented as illustrated in FIG. 10 in the following manner:

1. A multi-wire cable (1005) is attached to the lanyard (1006) and connected to the aerialift boom at the support D-ring side of the lanyard (1004).
2. The multi-wire cable (1005) runs the length of the safety lanyard and terminates at an optical transceiver (1007), including an optical transmitter and optical receiver sensor near the snap hook (1008).
3. The harness D-ring (1009) is surrounded with a reflective material (1010) which reflects light as emitted by the optical transmitter, such that when the optical transmitter is restrained near the harness D-ring (1009), the optical transceiver (1007) receives backscatter radiation that indicates that the lanyard snap hook (1008) is properly connected to the harness D-ring (1009). In this embodiment of the invention, as with others, the D-ring (1009) may in itself include a variety of functionally equivalent embodiments.

This embodiment makes use of an optical transmitter/receiver (1007) to scatter light off a reflective surface (1010) near or surrounding the harness D-ring (1009) and thus indicate the local presence of the end of the lanyard to the body harness. Since the present invention envisions inspection of this locality condition throughout any movement of the aerialift boom, the test of proper optical feedback from the body harness will ensure that the operator is properly secured with a lanyard prior to moving the aerialift boom/basket.

In the alternative, an optical/mechanical sensor combination may be used. Rather than detect the backscatter of optical radiation from the body harness, this approach uses a switch designed to detect optical blockage. Such switches have an optical transmitter and an optical receiver in close proximity with an air gap between the two. As an object comes between the transmitter and the receiver, this is electrically detected by the transmitter/receiver pair. Such devices are widely available as 'photo micro sensors' from companies such as Sunx of West Des Moines, Iowa.

This embodiment has the advantage of being relatively simple to implement. No major changes are required in the construction of conventional body harness, with the exception of the addition of reflective tape or the like surrounding the harness D-ring. Optical transmitter/receiver combinations are widely available, and are available in both the visible and invisible spectrum. Additionally, this embodiment has the same advantage as that of the magnetic interlock: a single point of hookup between the lanyard and the body harness.

However, this embodiment, as with the magnetic interlock system, requires an additional cable which must be attached to the lanyard.

Another drawback of this embodiment involves operator circumvention of the interlock mechanism. Both optical/reflective and optical/mechanical embodiments discusses are susceptible to defeat by operators who may be determined to override their inherent safety features.

Nonetheless, a relatively simple method of implementing the present invention has been shown which utilizes optical and/or optical/mechanical transmitter/receiver technologies to affect the required lanyard interlock detector.

Figure 11:
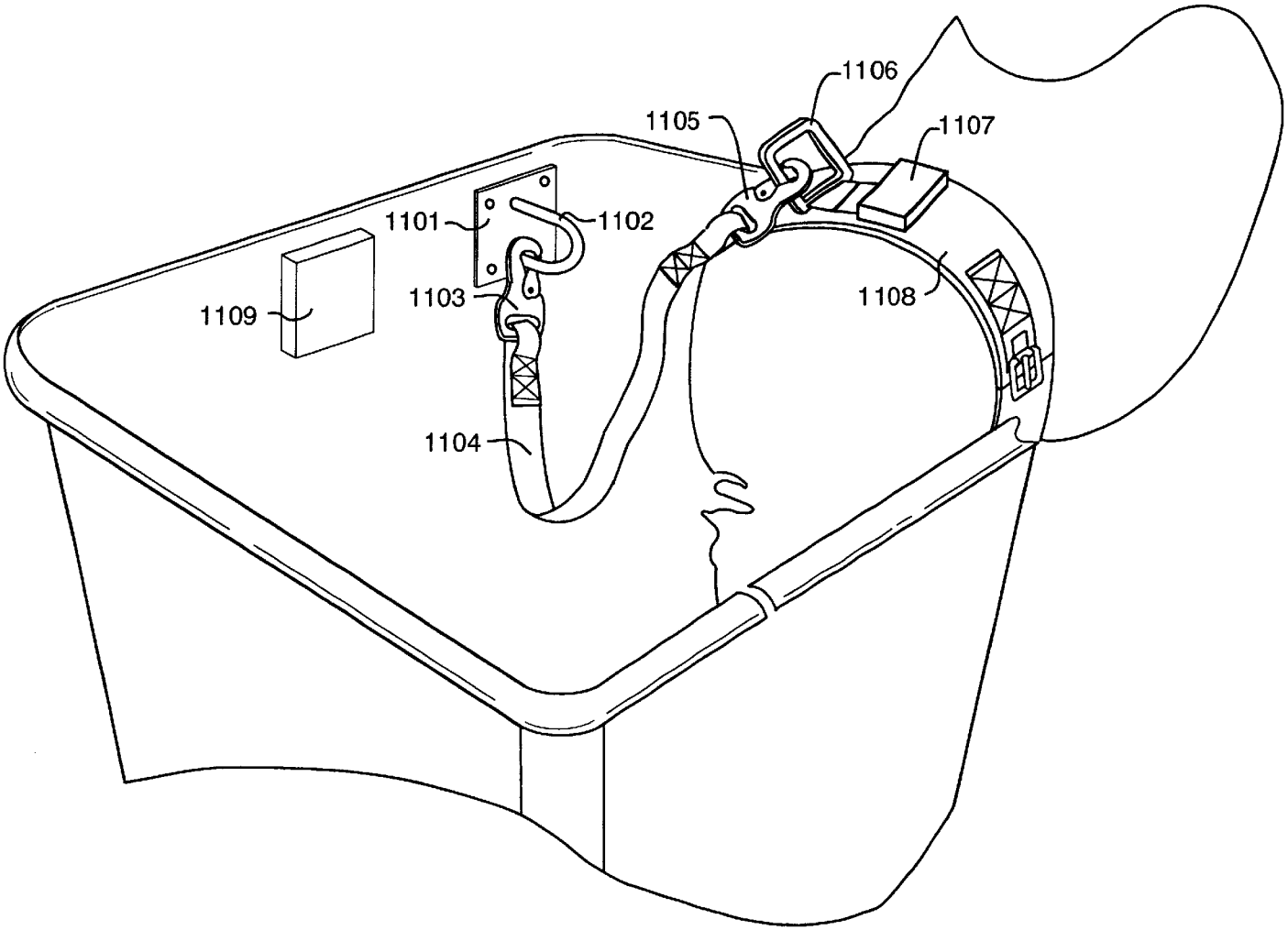
FIG. 11 illustrates another embodiment of the present invention using a radio frequency (RF) transmitter as the lanyard safety interlock means.

Another method of implementing the lanyard connection detector (222) (FIG. 2) is illustrated in FIG. 11. Here, the conventional one-piece lanyard (307) of FIG. 3 having two snap hooks (310, 312) connected via a nylon strap or the like is augmented as illustrated in FIG. 11 in the following manner:

1. The lanyard (1104) is coated/impregnated or otherwise treated with a marginally conductive material to make the lanyard marginally conductive, and therefore susceptible to the transmission of radio frequency (RF) energy.
2. A radio-frequency (RF) transmitter (1107) is electrically connected to the harness D-ring (1106) on the body harness (1108).
3. A radio frequency (RF) receiver (1109) is attached to the support D-ring (1102) on the aerialift boom/basket near the support bracket (1101).
4. The RF transmitter (1107) is designed to have no appreciable antenna, and therefore will be a very poor radiator of RF energy.
5. The RF transmitter (1107) is specifically designed (contrary to popular practice) to have a very low signal level present at its transmitter output, resulting in very low radiation levels at the body harness.
6. The RF receiver (1109) is designed to have no appreciable antenna, and therefore will be a very poor receiver of radiated RF energy.

7. The proper connection of the conductive lanyard (1104) from the aerialift boom/basket support D-ring (1102) to the harness D-ring (1106) permits sufficient RF energy to be directly conducted from the RF transmitter (1107) to the RF receiver (1109) to trigger an interlock threshold and permit the operator to move the aerialift boom/basket.

Figure 12:
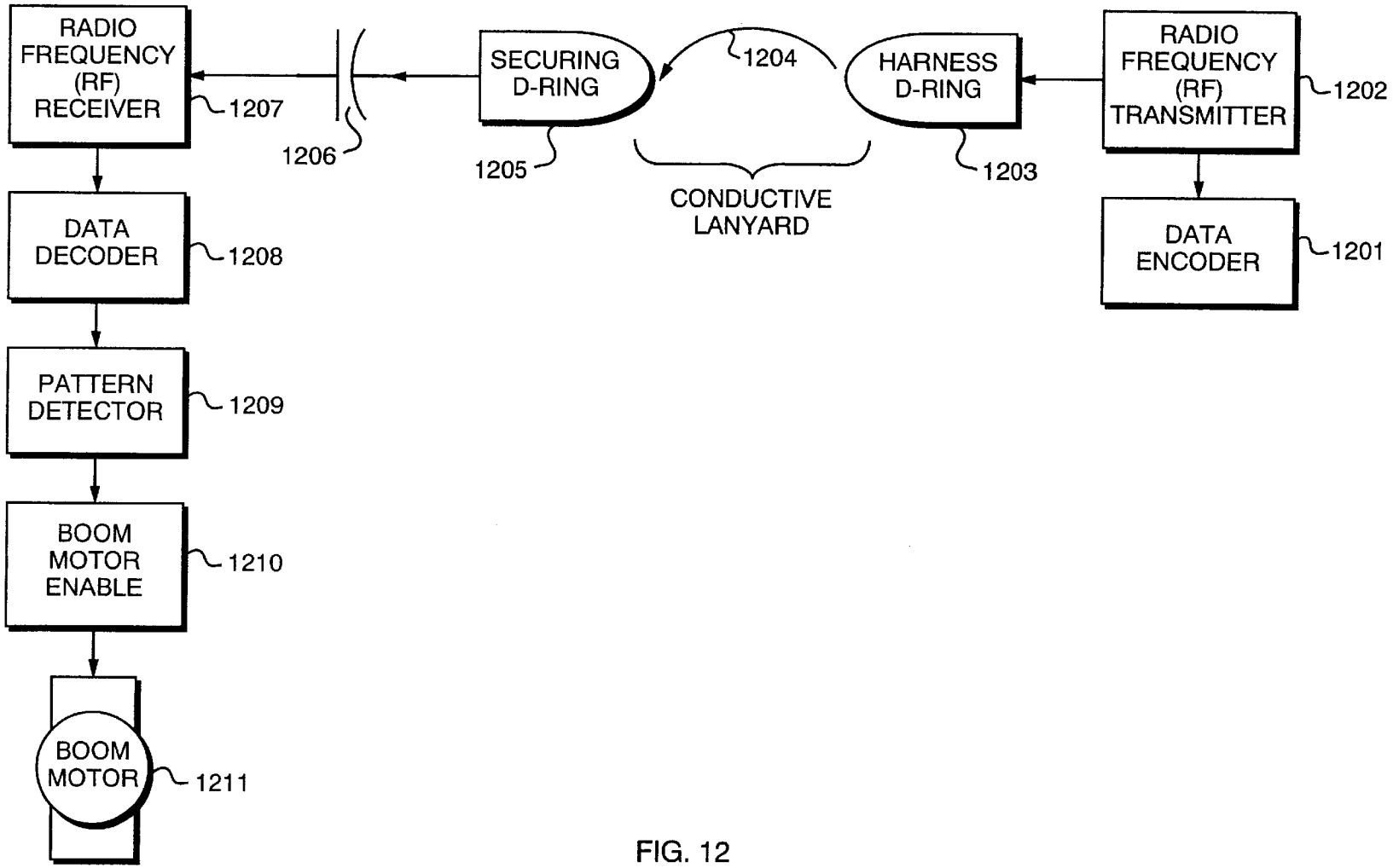
FIG. 12 illustrates an exemplary block diagram of a radio frequency (RF) lanyard interlock embodiment of the present invention using a conductive lanyard.

A basic block diagram illustrating a RF lanyard interlock embodiment is illustrated in FIG. 12. Here a data encoder (1201) generates a data stream which is used to modulate a RF transmitter (1202), which is specifically designed to have weak transmission characteristics. This transmitter (1202) is electrically connected to the harness D-ring (1203) which serves as a poor antenna for radiation purposes.

However, a conductive lanyard (1204) is used to conduct RF energy from the RF transmitter (1202) from the harness D-ring (1203) to the securing D-ring (1205). This RF energy is then DC blocked using an optional capacitor (1206) and then fed into an RF receiver which demodulates the data modulated in the RF carrier wave. This data is then decoded (1208) and checked by a pattern detector (1209) for a predetermined data pattern to decide if the boom motor enable (1210) should be activated. If the proper data pattern generated by the data encoder (1201) is matched, the boom motor (1211) is allowed to operate.

The key to this system is that the RF receiver (1207) and RF transmitter (1202) are gain degenerated by means of making their effective antenna structures very inefficient. Thus, RF energy will have very poor radiation characteristics from the transmitter and very poor gain characteristics at the receiver. However, by use of a conductive lanyard (1204), this energy can be efficiently transmitted between the harness D-ring (1203) and the securing D-ring (1205). Only when the connection of the conductive lanyard is complete will the signal strength of the RF transmitter generate sufficient RF energy at the RF receiver (1207) to trigger the boom motor. Note that the lanyard (1204) in this application need not be conductive in a DC sense of the word, but may be capacitively reactive as illustrated in FIG. 13. Here the lanyard (1304) is of the capacitive variety, which will be discussed in more detail with respect to FIGS. 16A, 16B and 16C below. With this type of lanyard, the capacitance of the lanyard is increased while maintaining its DC isolation characteristics.

Figure 13A:
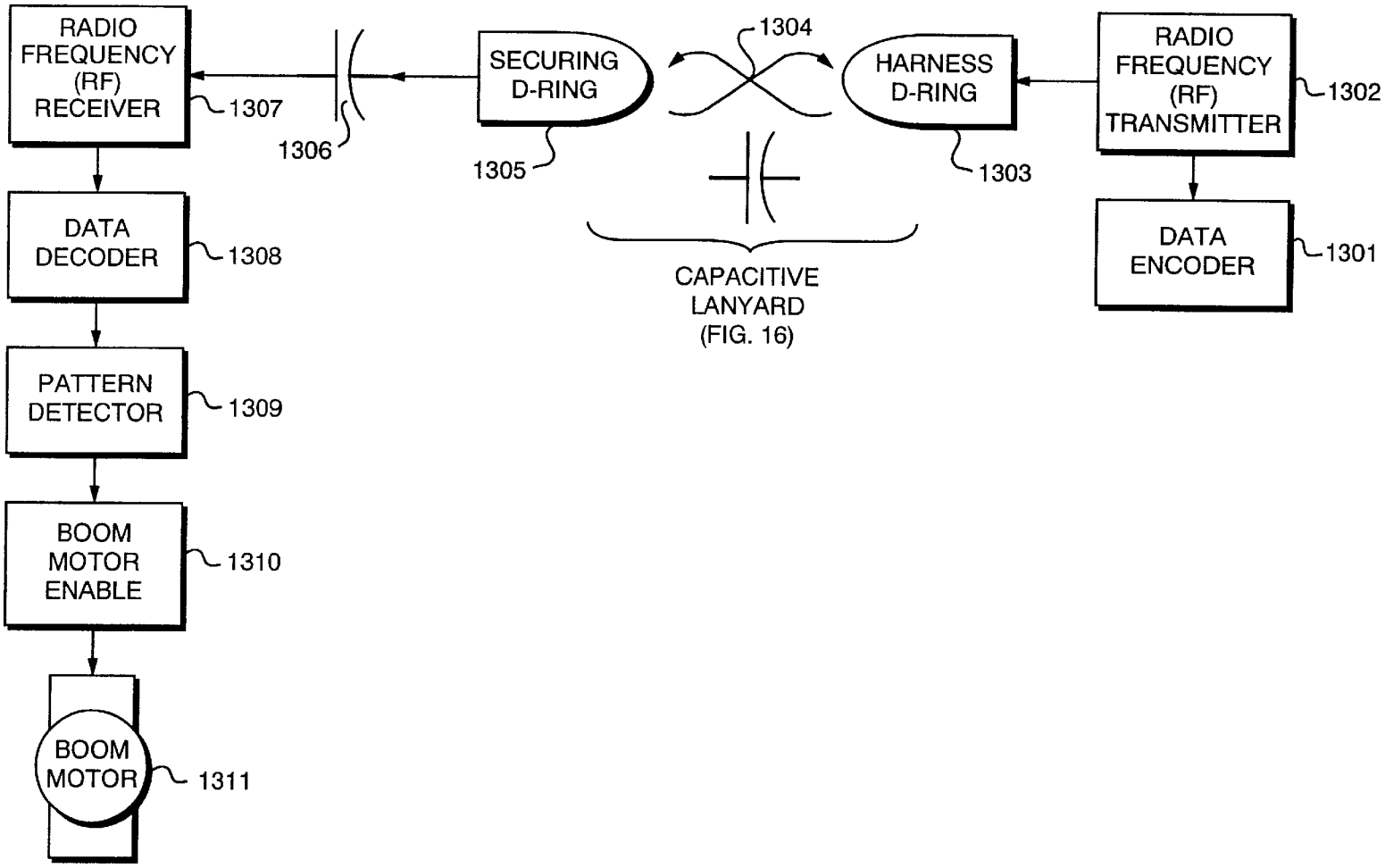
FIG. 13A illustrates an exemplary block diagram of a radio frequency (RF) lanyard interlock embodiment of the present invention using a capacitive lanyard.
Figure 13B:
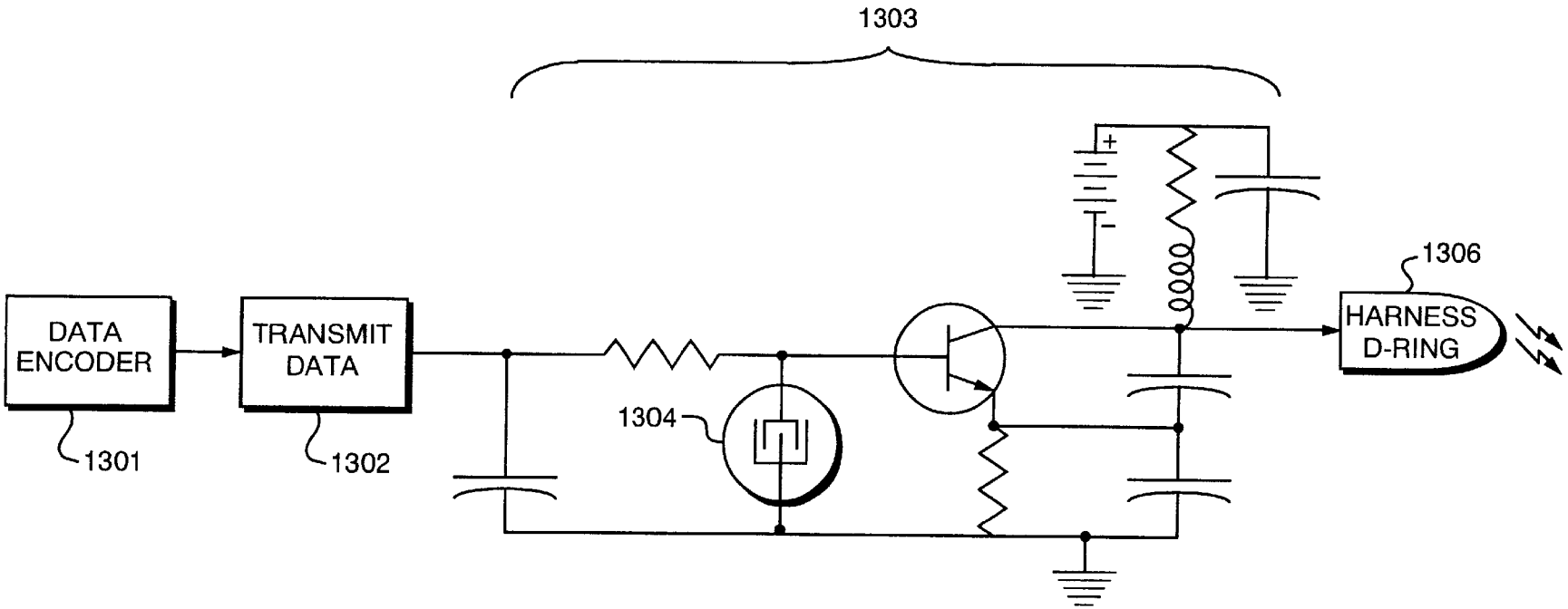
FIG. 13B illustrates an exemplary schematic of an RF transmitter which may be suitable for use in a radio frequency (RF) lanyard interlock embodiment of the present invention.

The RF transmitter (1302) can take a wide variety of forms. However, one or more embodiments may make use of SAW (surface acoustic wave) stabilize (1303), a typical embodiment of which is illustrated in FIG. 13B. SAW devices (1404) essentially perform the function of high-Q filters and are available from a wide variety of sources such as RF Monolithics (RFM) of Dallas, Tex.

Figure 14:
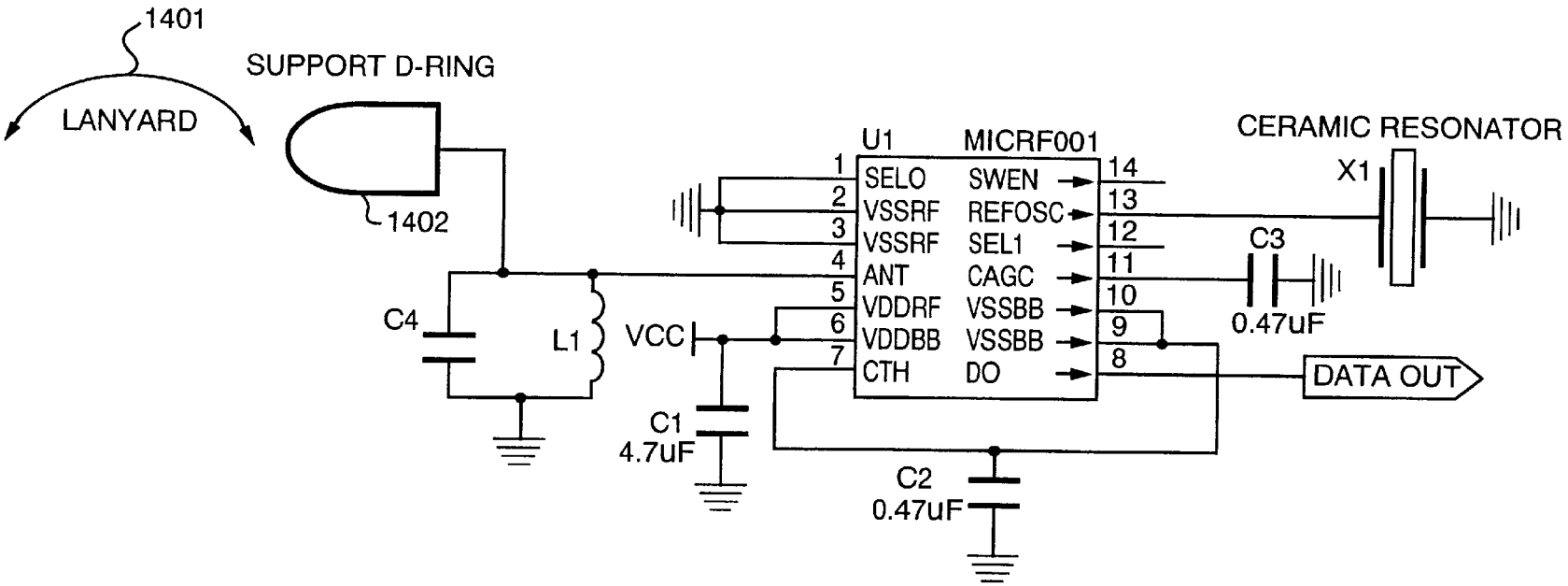
FIG. 14 illustrates an exemplary schematic of an RF receiver which may be suitable for use in a radio frequency (RF) lanyard interlock embodiment of the present invention.

The implementation of the RF receiver (1307) can be in a wide variety of forms, but several preferred embodiments make use of Micrel Semiconductor (San Jose, Calif.) QUICKRADIO(tm) brand RF receivers. As illustrated in FIG. 14, a typical embodiment of the RF receiver using this technology has the advantage of being a single-chip solution which can operate in the 300-900 MHz range. This makes use of SAW (surface acoustic wave) stabilized RF transmitters practical. The exemplary RF receiver embodiment of FIG. 14 takes RF energy from the lanyard (1401) to the support D-ring (1402) and filters it with an inductor/capacitor tank (C1/L1). This signal is then processed by a RF receiver integrated circuit (U1) which locks onto the RF carrier signal using a ceramic resonator (X1). Direct digital serial data output (DATAOUT) is provided by this embodiment which may be used as input into a data decoder and pattern detector as illustrated in FIG. 12 and FIG. 13A.

Figure 15:
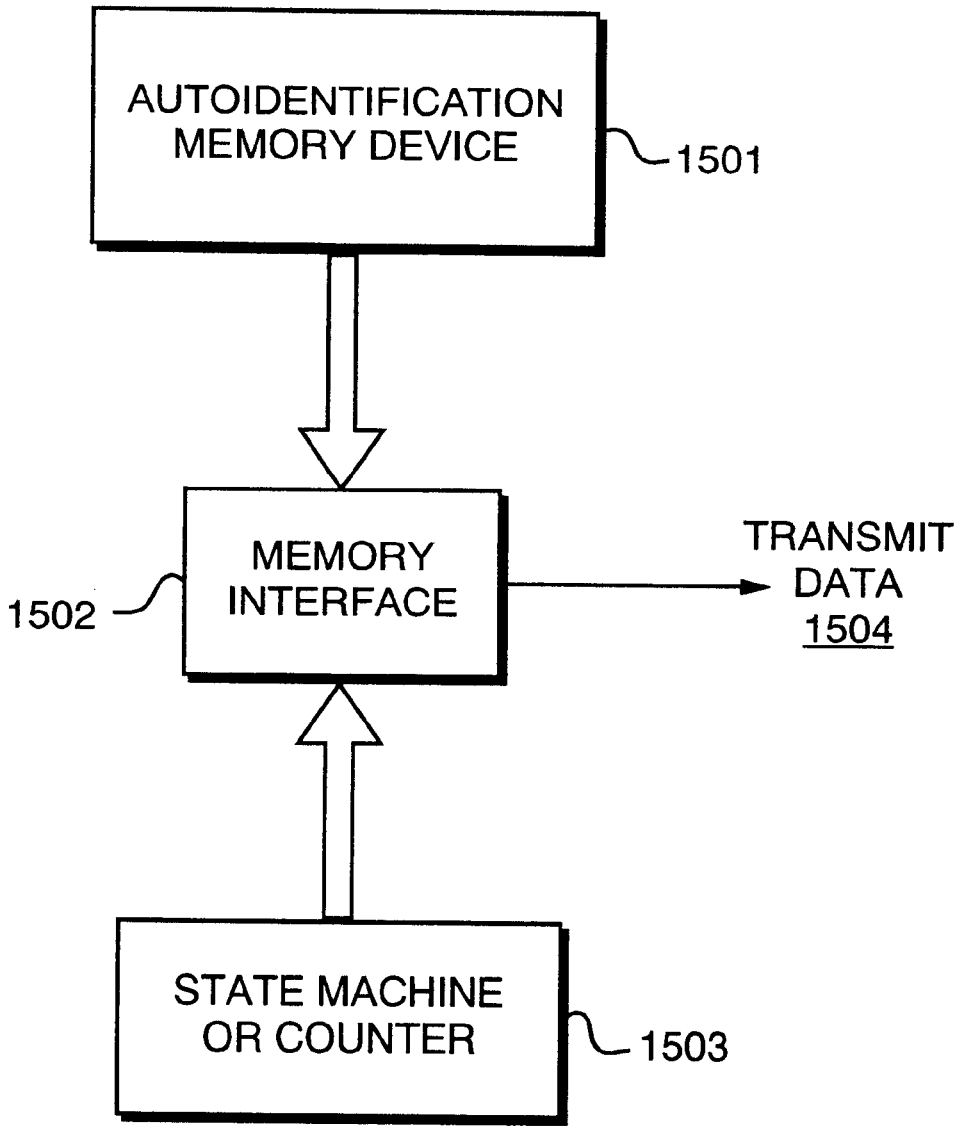
FIG. 15 illustrates an exemplary block diagram showing how autoidentification information may be transmitted over the safety lanyard in an RF lanyard interlock invention embodiment.

One significant advantage of this embodiment is the potential for uniquely identifying each body harness and/or operator via the use of an autoidentification memory device such as the iButton or other memory device such as sold by Dallas Semiconductor and mentioned previously. As illustrated in FIG. 15, an autoidentification memory device (1501) may be interrogated by a memory interface (1502) which is driven by a state machine (1503). The output of the memory interface (1502) may be used to generate data (1504) which uniquely identifies the body harness (and thus the operator) which is attempting to operate the aerialift boom. This tracking information can be used to determine which operators attempted to operate the aerialift boom without having an attached safety lanyard. This information can be subsequently used in the context of safety training or safety monitoring. This information could also be used in conjunction with permissive operator interlocks, which would be configured to only allow operators who are qualified to operate certain types of equipment to use such equipment. For example, an operator who is only trained and thus qualified to use a boom lift having a two story height capacity could be prevented from operating more capable boom lift equipment, such as a boom lift having a five story height capacity.

One significant aspect of this embodiment is the fact that from the operator's perspective, there is no change in the normal operation of the system. In fact, the implementation of this system makes very little change to existing hardware, with the exception of the RF transmitter which must be placed on every body harness. The remaining components can easily fit within the context of existing aerialift hardware.

The main disadvantage to this system is the requirement that the aerialift operator carry a RF transmitter on his/her body harness. This requirement necessitates the use of a battery to power the RF transmitter and therefore the cost of batteries is an ongoing maintenance issue. This cost is mitigate by two factors. First, the RF transmitter is operated at a very low current level to ensure that only a proper attachment of the lanyard between the RF transmitter and the RF receiver will trigger the interlock mechanism. Secondly, as described subsequently in FIGS. 17A, 17B and 18, it is possible to redesign the harness D-ring to integrate a switch mechanism which only enables the RF transmitter when the lanyard snap hook is engaged with the harness D-ring. Thus, this system limits the overall current consumption to just the actual time that the aerialift operator is secured with the lanyard to the aerialift boom/basket.

Nevertheless, this embodiment provides a robust lanyard interlock detection system which uses very low power RF transmitters and RF receivers to implement a positive compliance lanyard interlock.

Figures 16A, 16B, 16C:
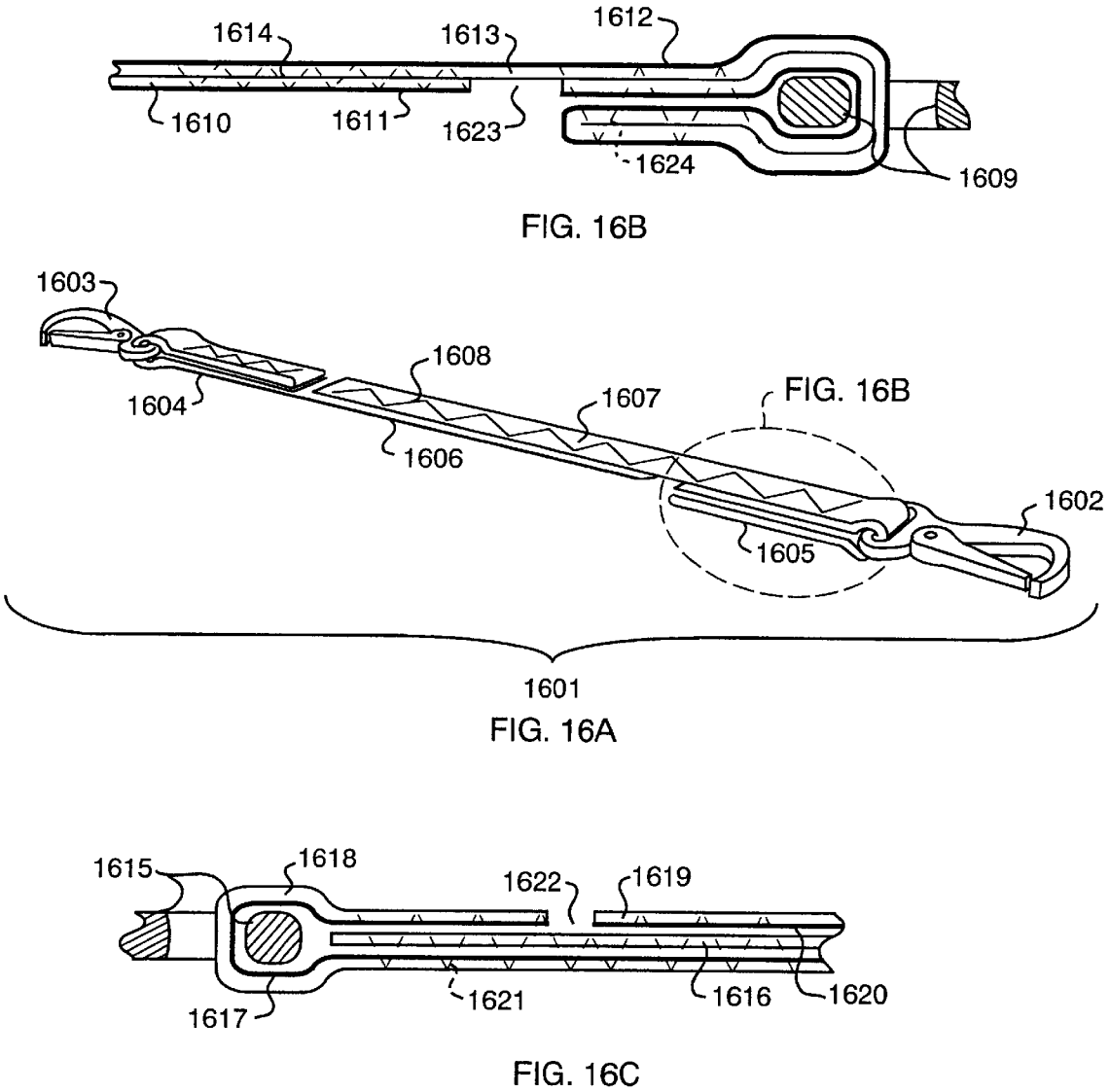
FIGS. 16A, 16B and 16C illustrate one embodiment of a lanyard which may be utilized with the radio frequency (RF) interlock scheme illustrated in FIG. 11 in which the lanyard is configured as a weak capacitor to facilitate the transmission of RF energy.

Yet another embodiment of the lanyard connection detector (222) (FIG. 2) is illustrated in FIGS. 16A, 16B and 16C. Here, the conventional one-piece lanyard (307) of FIG. 3 having two snap hooks (310, 312) connected via a nylon strap or the like is augmented as illustrated in FIGS. 16A, 16B and 16C in the following manner:

1. The configuration of the RF interlock of FIG. 11 is used, with only a modification to the safety lanyard.
2. The safety lanyard (1601) is constructed with first and second conductive strips (1614, 1611) on either side of the lanyard such that the strips form a parallel plate capacitor, with a non-conductive lanyard webbing material (1613) acting as the dielectric between the capacitor 'plates' which are formed by the opposing conductive strips.

3. Conductive fasteners, such as snap hooks (1602, 1603), at either end of the lanyard are electrically connected to the opposing conductive strips within the lanyard, such that each of the two snap hooks (1609, 1615) represents a connection to each of the two corresponding 'plates' of the lanyard capacitor (1612, 1617).
4. A variety of methods of interdigitating the dielectric and conductive portions of the lanyard capacitor are possible, by placing the electrical conductors on the outside of the lanyard and wrapping them around the lanyard snap hook (1609) or by placing the electrical conductors in the inside of the lanyard and wrapping them around the lanyard snap hook (1615).
5. Depending on the application, the lanyard strap may be double-wrapped (1605) around the snap hook (1602) or single-wrapped (1604) around the snap hook (1603).
6. Sewn stitching (1608, 1624, 1621) or other similar fastening means is used to keep the dielectric and conductive elements of the lanyard capacitor together.

In this embodiment of the RF interlock, the lanyard is constructed to be non-conductive to DC current and conductive in an AC sense to RF AC current. Instead of impregnating the lanyard (1601) to make it conductive as in the RF interlock embodiment, this approach permits the operator to be exposed to high voltage levels and still remain electrically isolated from the remainder of the electrical system of the aerialift boom/basket. This is important in some applications where the operator is exposed to high voltage lines such as in power pole maintenance.

As to the operation of this particular embodiment, it should be noted that while the lanyard in this configuration is not conductive to DC currents, it can be made highly conductive to AC current at RF frequencies. For example, a lanyard that is two feet long with nylon webbing one inch wide and 0.25 inch thick has the capacitance C (assuming parallel plates on opposing surfaces of the web) given by the relation $$C = \frac{\varepsilon_r \varepsilon_0 A}{d}$$

where $\epsilon_r$=relative dielectric constant of nylon $\epsilon_0$=dielectric constant of free space (F/m)

A=effective capacitor plate area ($m^2$)

d=distance between capacitor plates (m)

Given the facts above, the effective capacitance of a lanyard capacitor so constructed would be given approximately by $$C = \frac{(3.1)(8.854\times10^{-12})(2\times12\times1\times0.0254^2)}{(0.25\times0.0254)} \approx 67\ \text{pF}$$

See Roger F. Harrington, Time-Harmonic Electromagnetic Fields (ISBN 07-026745-6, 1961), for more information concerning the dielectric constant of various materials. Assuming a RF transmission frequency of 300 MHz, the effective impedance Z of this capacitor is given by the relation $$|Z| = \frac{1}{\omega C} = \frac{1}{2\pi f C}$$

-continued $$|Z| = \frac{1}{(2)(3.14)(3\times10^8)(67\times10^{-12})} \approx 8\Omega$$

Thus, the impedance Z of the lanyard capacitor is approximately a short of 8 ohms or so, certainly a much lower impedance than that provided by an open air dielectric between the RF transmitter and the RF receiver connected to the securing D-ring at the aerialift boom/basket.

As illustrated in FIGS. 16B and 16C, two preferred embodiments of the capacitive lanyard (1601) are detailed. The first (FIG. 16B) comprises an external conductive element (1612) placed over a lanyard strap and double-wrapped around the snap hook (1609). In this embodiment, two mirror components of this construction are connected together with sewing or other similar fastening means (1624). A gap (1623) exists between the mirror element (1611) and the end of the snap ring to ensure that the secondary conductor (1610) does not short to the first conductor (1613).

The embodiment (FIG. 16C) is similar in concept, except it constrains the electrical conductor to be inside the lanyard (1618) so that the conductor (1617) makes contact with the snap hook (1615) when the lanyard is engaged properly. Note that a similar gap (1622) exists in this embodiment to ensure that the two conductors (1620, 1617) do not short together, thus providing dc isolation of the two snap hooks (1602, 1603).

One advantage to this particular embodiment is safety in that a higher degree of DC isolation is possible between the aerialift operator and the surrounding aerialift boom/basket electrical system.

Thus, this embodiment illustrates how with a slight modification to the safety lanyard a high degree of DC isolation can be maintained between the operator and the aerialift boom/basket electrical system.

Figure 17B:
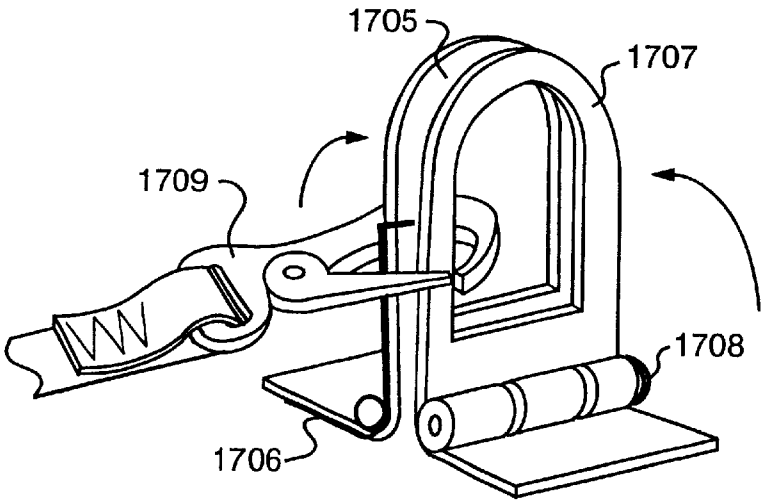
FIGS. 17A and 17B illustrate one embodiment of a harness D-ring which may be used to provide an activation interlock for the RF transmitter interlock illustrated in FIG. 11.
Figure 17A:
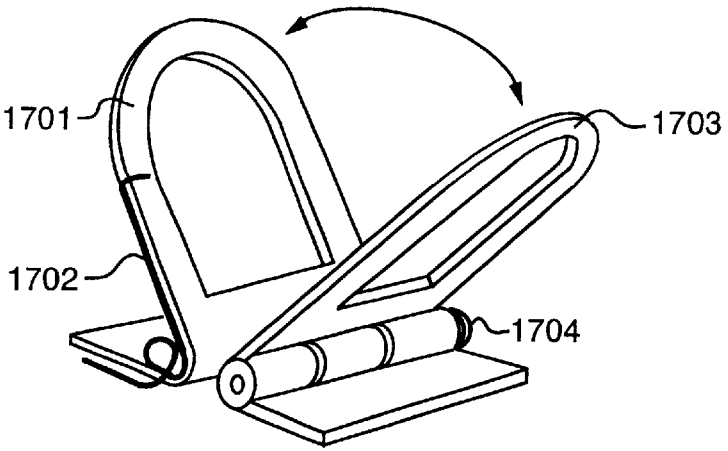

Another method of implementing the lanyard connection detector (222) (FIG. 2) is illustrated in FIGS. 17A and 17B. Here, the conventional one-piece lanyard (307) of FIG. 3 having two snap hooks (310, 312) connected via a nylon strap or the like is augmented in the following manner:

1. The configuration of the RF interlock is used, with only a modification to the harness D-ring.
2. The conventional harness D-ring assembly is reconfigured to include two D-rings (1701, 1703) instead of a single D-ring.
3. The two harness D-rings (1701, 1703) are constructed so as to have a spring action (1702, 1704) which normally biases the curved ends of each D-ring apart from each other.
4. The two harness D-rings (1701, 1703) are electrically isolated from each other so as to prevent their electrical contact until and unless their natural spring action (1702, 1704) is overcome by an overt operator action thus forcing the curved ends of each D-ring to the opposing D-ring, as illustrated by positions (1705, 1707) and snap clip (1709).
5. Electrical contact is made to each harness D-ring so as to affect an electrical contact when the lanyard snap hook (1709) is engaged across both D-rings (1705, 1707) after their natural spring action (1708) has been overcome by an overt operator action.

This embodiment specifically addresses the RF transmitter battery life issue presented by the RF interlock embodiment. Normally, the RF transmitter in this application would be activated via the use of a conventional switch or the like. This is problematic in that if the operator forgets to turn off the switch the RF transmitter will operate continuously, thus seriously degrading battery life.

Figure 18:
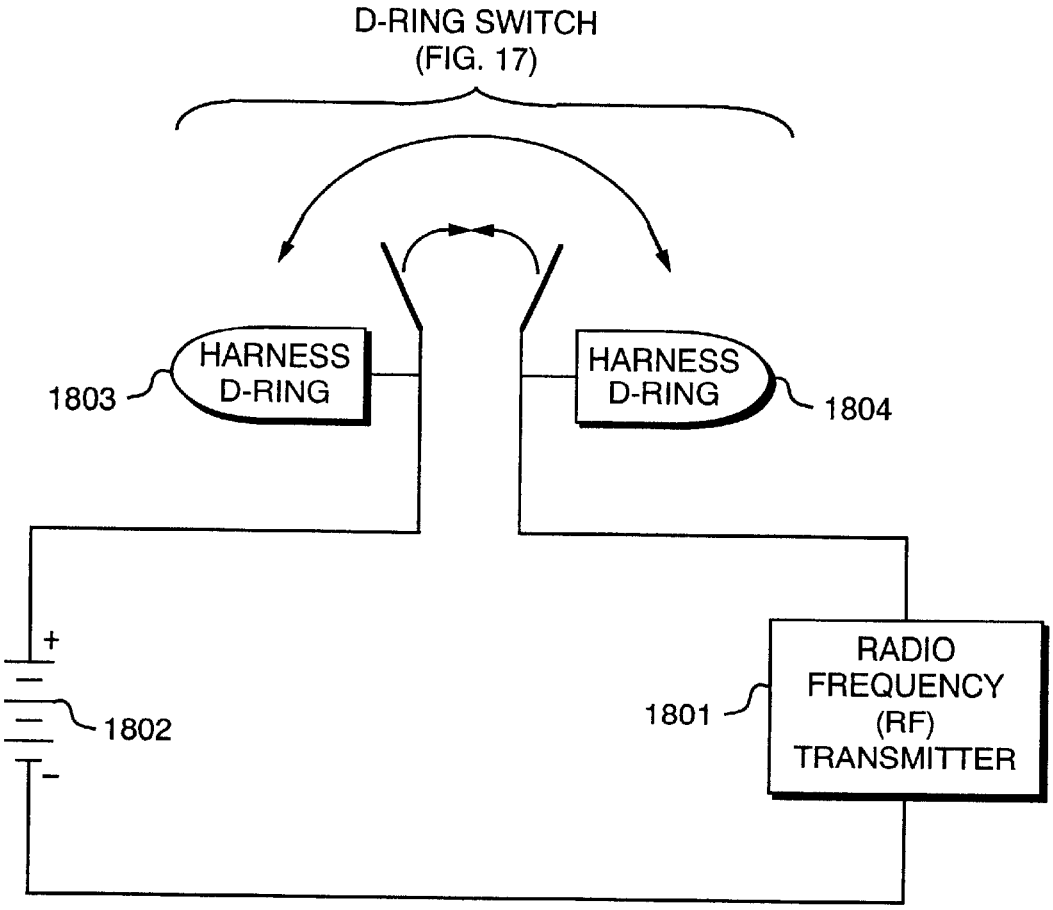
FIG. 18 illustrates how the harness D-rings may be utilized as a power switching means to conserve battery power in an RF lanyard interlock invention embodiment.

A solution to this problem as illustrated in FIG. 18 is to provide a switch to selectively activate the RF transmitter in the body harness only when the operator has positively engaged the safety lanyard snap hook through TWO opposing harness D-rings (illustrated in FIG. 17B) which form the activation circuit for the RF transmitter. Thus, in its normal configuration, with no lanyard attachment, the RF transmitter would be inactive.

As illustrated in FIG. 18, this objective is achieved by using the harness D-rings (1803, 1804) as elements of a conductive switch which is made when the harness D-rings are brought together and contacted with the metallic conductor of the lanyard snap hook, thus supplying power from the battery (1802) to the RF transmitter (1801). Additionally, by spring loading the harness D-rings as illustrated in FIG. 17, they remain separated during times in which the lanyard snap hook does not fully engage BOTH D-rings.

There are a wide variety of methods to affect the separation of the harness D-rings, including conventional springs, spring steel inserts between the rings, as well as the use of spring steel inserts in the support brackets which restrain the D-rings to the harness.

The clear advantage to this implementation of the RF interlock is the potential for long-term battery savings. While the RF interlock is designed to operate a very low transmission levels, it is nonetheless highly desirable to have as long a battery life as possible in this application. Additionally, this configuration provides the feature of prohibiting the operator from circumventing the RF interlock by merely touching the harness D-ring to the support D-ring on the aerialift boom/basket. In this configuration, the contact between the harness D-rings is generated by the lanyard snap hook, meaning that the RF transmitter will ONLY be active when this safety procedure has been properly enforced.

Furthermore, this embodiment makes the case for an improvement in body harness design wherein the RF transmitter also detects the proper belting of the body harness around the operator's body as a prerequisite to activation of the RF transmitter.

Therefore, the use of a double D-ring within the context of the body harness to promote extended RF transmitter battery life has been demonstrated. This embodiment both promotes battery life as well as providing additional methods of preventing circumvention of the lanyard safety interlock system. While the disadvantage of this system is one of implementation cost, these positive feature improvements may justify the additional cost in some environments.

In typical operation, the invention will be configured such that the lanyard interlock will provide sufficient control information to prevent operation of the aerialift boom/basket or the like in the absence of a properly attached safety lanyard. Note, however, that the ability to sense whether the safety lanyard is properly attached permits this information to be used for purposes other than positive safety enforcement as illustrated by the safety monitoring and speech/audible warning feedback system in FIG. 19.

Figure 19:
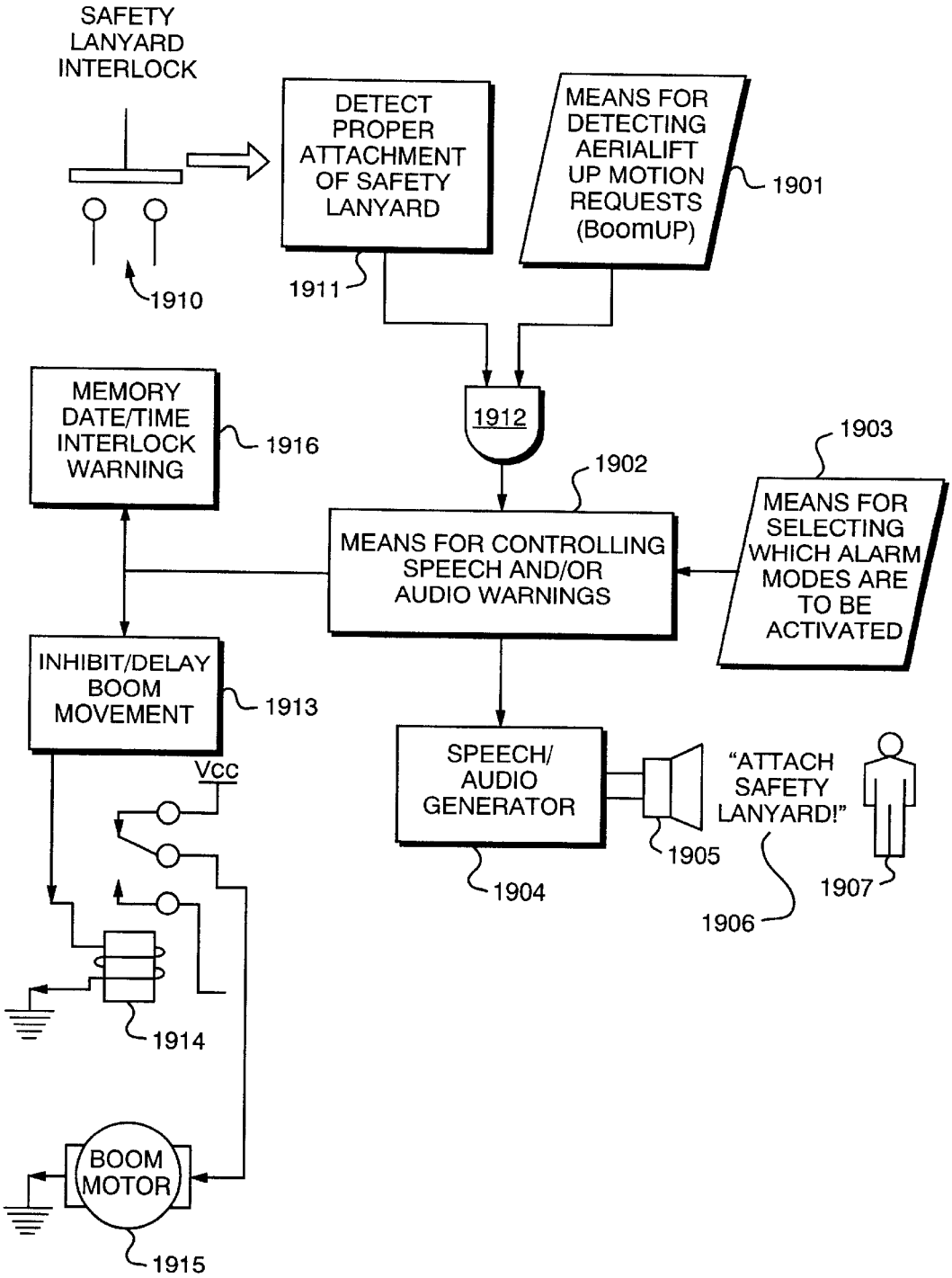
FIG. 19 illustrates an embodiment of the present invention used in conjunction with a speech and/or audible warning system capable of providing and logging operator warning messages in the event of a safety protocol violation involving proper safety lanyard use.

Referencing FIG. 19, this system in general is designed to provide both a safety interlock as well as give the operator speech safety messages and log the occurrence of any safety violations during the course of a given day. Safety interlock (1910) can be used as input to a digital latch or other sensing element to detect proper attachment of the safety lanyard (1911). This information, in conjunction with a means for detecting aerialift UP motion requests (1901), can provide information which may be logically ANDed (1912) to provide a trigger to a speech and/or audio warning controller (1902). This controller (1902) issues audio commands to an audio generator (1904), which, in turn, provides audio alarm signals (1906) using speaker (1905) to advise the operator (1907) in the event that that operator (1907) attempts to move the aerialift boom/basket without a proper safety lanyard attachment. This safety protocol violation may also be logged with a date/time stamp into an event memory (1916), which may be later interrogated by safety monitoring personnel or federal regulatory agencies such as OSHA. This information may also be used to provide control to inhibit (1913) the activation of boom movement motors (1915) via a suitable current controller means (1914). Given the wide variety of warning configurations, languages in which the warning messages can be generated, and other system variables, it is envisioned that an alarm selection activator (1903) will be incorporated in this system.

Thus, the safety lanyard interlock can form a important piece of a much broader safety management system that is designed to totally manage the safety threats surrounding the use of aerialift boom/baskets and the like.

In certain circumstances several of the present invention embodiments can be used in contexts which extend beyond the major application of fall prevention. For example, the RF interlock embodiment of the present invention can be used in conjunction with a safety lanyard to provide positive identification of a given operator to ensure that the operator is properly licensed to operate the machinery, or has been properly trained to use the machinery. This extension of the fall prevention protection envelope can be accomplished in this application because the RF transmission from each safety harness can be made unique via the use of an autoidentification circuit. A similar unique operator identification scheme can be had using the dual lanyard embodiment. Thus, while the present invention and its embodiments permits the enforcement of positive safety procedures regarding elevation devices in general, it may in some circumstances permit the tracking and positive enforcement of other safety policies and procedures outside the narrow scope of fall protection and prevention.

Figure 20:
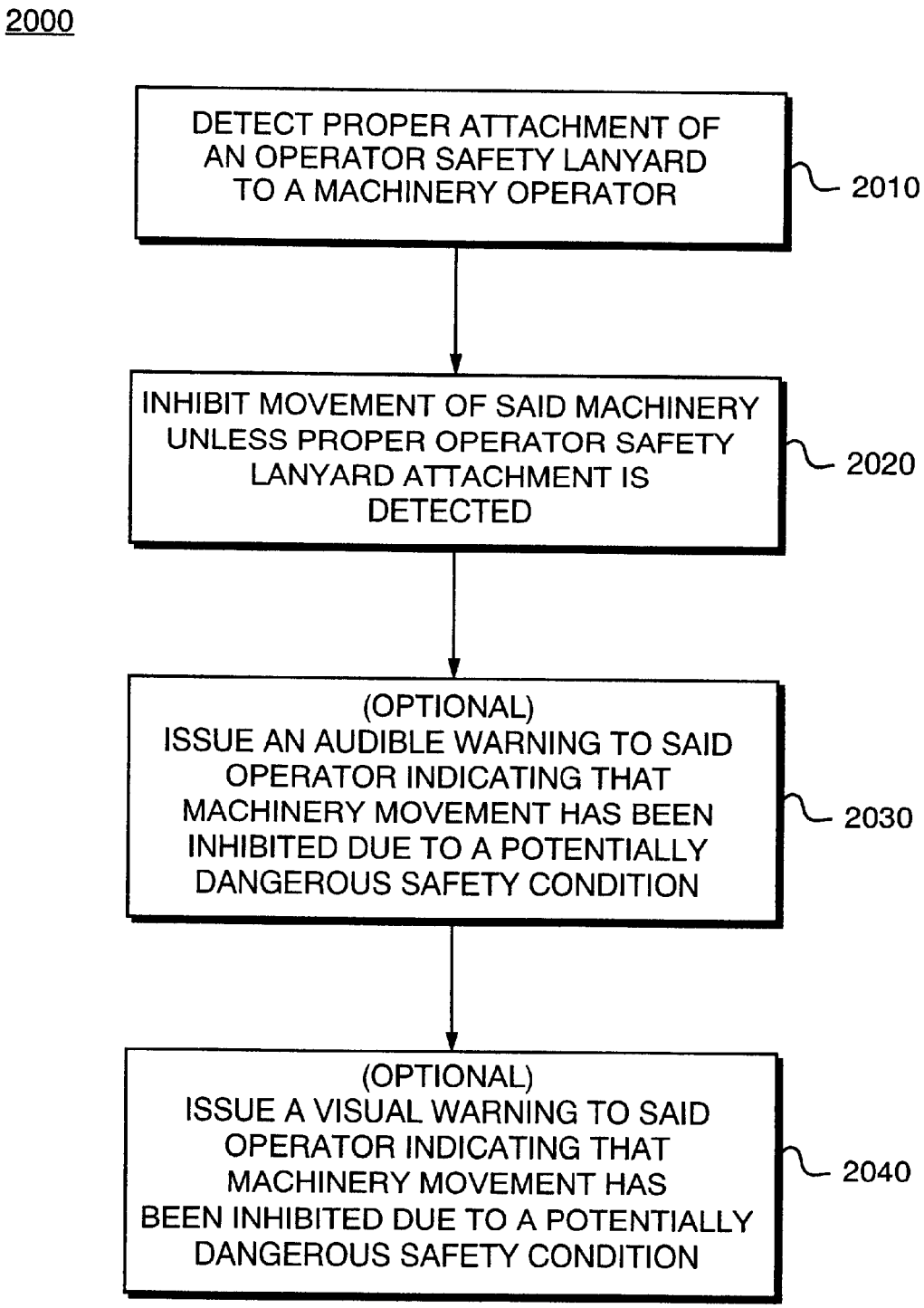
FIG. 20 is a flow chart showing the steps of a method of providing operator protection according to the teachings of the present invention.

FIG. 20 shows a flow chart of one method (2000) of providing operator protection according to the teachings of the present invention. The method begins by detecting whether an operator safety lanyard is properly attached to a machinery operator (step 2010). Then, unless proper operator safety lanyard attachment is detected, the method inhibits movement of the machinery (step 2020). The method (2000) may utilize any of the various embodiments discussed above to accomplish the lanyard attachment detection and movement inhibition steps.

The method may optionally include the step of issuing an audible warning to an operator indicating that machinery operation/movement has been inhibited due to a potentially dangerous safety condition (step 2030). In addition or in the alternative, the method may include the step of issuing a visual warning to the operator to indicate that machinery operation has been inhibited due to a potentially dangerous safety condition. (step 2040).

Accordingly, a system and method for providing a safety interlock for fall arresting lanyards is disclosed. Significantly, this system takes a positive approach to preventing injury to aerialift boom operators and the like with respect to injuries caused by falls and similar accidents. It should be realized that the present invention may be incorporated into a more widespread aerialift safety threat management system incorporating verbal and/or audible alarms that permit safety feedback information to be given to the operator. In these circumstances, the aerialift operator can be informed of corrective safety measures should he/she attempt to operate the aerialift boom/basket without proper safety lanyard attachment. This type of system is envisioned as being complementary to the present invention, as the present invention permits a wide variety of methods to be applied specifically to the task of determining when the aerialift boom operator is properly secured with a safety lanyard.

Modifications and substitutions by one of ordinary skill in the art are considered to be within the scope of the present invention which is not to be limited except by the claims which follow.

What is claimed is:

1. An operator protection system for preventing the use of machinery unless an operator of said machinery is secured to said machinery with at least one lanyard to prevent said operator from falling to the ground from at least a portion of said machinery capable of being elevated with respect to the ground, said system comprising:

a lanyard connection detector for detecting proper attachment of said at least one lanyard intermediate said operator and said machinery; and a lanyard interlock control for controlling a switch to selectively enable activation of said machinery when said at least one lanyard connection detector indicates that said at least one lanyard is properly attached intermediate said operator and said machinery.

2. The operator protection system of claim 1, wherein said machinery comprises an aerialift system.

3. The operator protection system of claim 2, wherein said aerialift system comprises a boom/basket system, including an operator basket suspended from a boom, said boom activated by a boom motor.

4. The operator protection system of claim 1 further comprising an audio warning controller, an audio generator, and a speaker for providing audio alarm signals to said operator if said operator attempts to operate said machinery without a proper lanyard attachment.

5. The operator protection system of claim 4, further comprising an alarm selection activator for selecting one of a plurality of warning messages to broadcast to said operator.

6. An operator protection system for preventing the operation of an aerialift system unless an operator of said aerialift system is secured to said aerialift system with at least one lanyard to prevent said operator from falling to the ground from at least a portion of said aerialift system capable of being elevated with respect to the ground, said system comprising:

a lanyard connection detector for detecting proper attachment of said at least one lanyard intermediate said operator and said aerialift system; and a lanyard interlock control for controlling a switch to selectively enable activation of said aerialift system when said at least one lanyard connection detector indicates that said at least one lanyard is properly attached intermediate said operator and said aerialift system.

7. A method of protecting a machinery operator from falling to the ground from at least a portion of said machinery that is capable of being elevated by preventing the use of said machinery unless said machinery operator is secured to said machinery with at least one safety lanyard, said method comprising the steps of:

detecting when said at least one safety lanyard is properly attached intermediate said machinery operator and said machinery; and inhibiting operation of said machinery unless proper operator safety lanyard attachment is detected.

8. The method of claim 7 further comprising the step of providing an audible warning alarm if said operator attempts to use said machinery without proper safety lanyard attachment.

9. The method of claim 7, wherein said step of inhibiting operation of said machinery comprises interrupting power to said machinery.

* * * * *